US010811181B2

(12) United States Patent
Parish et al.

(10) Patent No.: US 10,811,181 B2
(45) Date of Patent: Oct. 20, 2020

(54) EMBEDDED MAGNETIC COMPONENT DEVICE

(71) Applicant: Murata Manufacturing Co., Ltd., Nagaokakyo-shi, Kyoto-fu (JP)

(72) Inventors: Scott Andrew Parish, Milton Keynes (GB); Christopher Featherstone, Milton Keynes (GB)

(73) Assignee: MURATA MANUFACTURING CO., LTD., Kyoto (JP)

( * ) Notice: Subject to any disclaimer, the term of this patent is extended or adjusted under 35 U.S.C. 154(b) by 445 days.

(21) Appl. No.: 15/054,412

(22) Filed: Feb. 26, 2016

(65) Prior Publication Data

US 2016/0254089 A1 Sep. 1, 2016

(30) Foreign Application Priority Data

Feb. 26, 2015 (GB) ..... 1503270.9

(51) Int. Cl.

| | |
|---|---|
| ***H01F 27/30*** | (2006.01) |
| ***H01F 27/26*** | (2006.01) |
| ***H01F 27/28*** | (2006.01) |
| ***H01F 41/04*** | (2006.01) |

(52) U.S. Cl.

CPC ..... *H01F 27/266* (2013.01); *H01F 27/2804* (2013.01); *H01F 27/2895* (2013.01); *H01F 41/046* (2013.01); *H01F 2027/2819* (2013.01)

(58) Field of Classification Search

CPC ..... H01F 27/2804; H01F 27/2895; H01F 17/0006; H01F 27/292; H01F 41/041

USPC ..... 336/199, 200, 221; 29/602.1

See application file for complete search history.

(56) References Cited

U.S. PATENT DOCUMENTS

| | | | | |
|---|---|---|---|---|
| 3,184,719 A * | 5/1965 | Perkins | G11C 5/05 29/604 |
| 6,148,500 A * | 11/2000 | Krone | H01F 17/0033 29/602.1 |
| 6,686,824 B1 * | 2/2004 | Yamamoto | H01F 17/0006 29/601 |
| 7,690,110 B2 * | 4/2010 | Whittaker | H01F 17/0033 174/264 |

(Continued)

OTHER PUBLICATIONS

Kneller et al.; "Embedded Magnetic Component Device"; U.S. Appl. No. 14/825,332, filed Aug. 13, 2015.

(Continued)

*Primary Examiner* — Elvin G Enad

(74) *Attorney, Agent, or Firm* — Keating & Bennett, LLP

(57) ABSTRACT

In a method of manufacturing a plurality of embedded magnetic component devices, a row of cavities for respective magnetic cores is formed in an insulating substrate. Neighboring cavities are connected to each other by channels formed in the substrate. Adhesive is applied to a cavity floor throughout the row of cavities, and magnetic cores are inserted into the cavities. The cavities and magnetic cores are covered with a first insulating layer. Through holes are formed through the first insulating layer and the insulating substrate, and plated up to form conductive vias. Metallic traces are added to the exterior surfaces of the first insulating layer and the insulating substrate to form upper and lower winding layers. The metallic traces and conductive vias form the windings for an embedded magnetic component, such as transformer or inductor.

2 Claims, 14 Drawing Sheets

(56) References Cited

U.S. PATENT DOCUMENTS 7,972,936 B1 * 7/2011 Brewer ..... H01L 21/185 438/312
8,581,114 B2 * 11/2013 Harrison ..... H01F 17/0033 174/266
9,355,769 B2 * 5/2016 Quilici ..... H01F 17/0033
10,015,885 B2 * 7/2018 Jung ..... H05K 1/183
2008/0186124 A1 * 8/2008 Schaffer ..... H01F 27/2895 336/200
2009/0077791 A1 * 3/2009 Quilici ..... H01F 17/0033 29/602.1
2011/0108317 A1 * 5/2011 Harrison ..... H01F 17/0033 174/266
2011/0123808 A1 * 5/2011 Lee ..... H05K 1/185 428/411.1
2011/0164391 A1 * 7/2011 Shin ..... H01L 23/13 361/761
2012/0024583 A1 * 2/2012 Lee ..... H05K 1/186 174/260
2014/0116758 A1 * 5/2014 Li ..... H05K 1/165 174/255
2014/0266549 A1 * 9/2014 Huang ..... H05K 1/165 336/200
2015/0061817 A1 * 3/2015 Lee ..... H01F 17/0033 336/221
2015/0101854 A1 * 4/2015 Lee ..... H01F 27/2804 174/260
2015/0107883 A1 * 4/2015 Huang ..... H01F 27/2804 174/255

OTHER PUBLICATIONS

Parish et al.; "Embedded Magnetic Component Device"; U.S. Appl. No. 14/825,327, filed Aug. 13, 2015.
Francis; "Embedded Magnetic Component Device"; U.S. Appl. No. 14/883,854, filed Oct. 15, 2015.
Wang et al.; "Embedded Magnetic Component Transformer Device"; U.S. Appl. No. 14/883,855, filed Oct. 15, 2015.
Kneller; "Embedded Magnetic Component Transformer Device"; U.S. Appl. No. 14/883,859, filed Oct. 15, 2015.
Kneller; "Embedded Magnetic Component Transformer Device"; U.S. Appl. No. 14/883,863, filed Oct. 15, 2015.
Wang et al.; "Embedded Magnetic Component Transformer Device"; U.S. Appl. No. 14/883,866, filed Oct. 15, 2015.
Kneller et al.; "Embedded Magnetic Component Transformer"; U.S. Appl. No. 15/019,240, filed Feb. 9, 2016.
Lloyd; "Embedded Magnetic Component"; U.S. Appl. No. 15/049,414, filed Feb. 22, 2016.
Harber; "Embedded Magnetic Component Device"; U.S. Appl. No. 15/050,536, filed Feb. 23, 2016.
Kneller et al., "Multi-tap Winding Design for Embedded Transformer", U.S. Appl. No. 15/498,765, filed Apr. 27, 2017.
Francis, "Power Electronics Device with Improved Isolation Performance", U.S. Appl. No. 15/498,769, filed Apr. 27, 2017.
Kneller et al., "DC-DC Converter Device", U.S. Appl. No. 15/703,086, filed Sep. 13, 2017.

* cited by examiner

EMBEDDED MAGNETIC COMPONENT DEVICE

BACKGROUND OF THE INVENTION

1. Field of the Invention

The present invention relates to embedded magnetic component devices, and in particular to embedded magnetic component devices with improved isolation performance.

2. Description of the Related Art

Power supply devices, such as transformers and converters, involve magnetic components such as transformer windings and often magnetic cores. The magnetic components typically contribute the most to the weight and size of the device, making miniaturization and cost reduction difficult.

In addressing this problem, it is known to provide low profile transformers and inductors in which the magnetic components are embedded in a cavity in a resin substrate, and the necessary input and output electrical connections for the transformer or inductor are formed on the substrate surface. A printed circuit board (PCB) for a power supply device can then be formed by adding layers of solder resist and copper plating to the top and/or bottom surfaces of the substrate. The necessary electronic components for the device may then be surface mounted on the PCB. This allows a significantly more compact and thinner device to be built.

In US2011/0108317, for example, a packaged structure having a magnetic component that can be integrated into a printed circuit board, and a method for producing the packaged structure, are described. In a first method, illustrated in FIGS. 1A to 1E, an insulating substrate 101, made of epoxy based glass fiber, has a cavity 102 (FIG. 1A). An elongate toroidal magnetic core 103 is inserted into the cavity 102 (FIG. 1B), and the cavity is filled with an epoxy gel 104 (FIG. 1C) so that the magnetic component 103 is fully covered. The epoxy gel 104 is then cured, forming a solid substrate 105 having an embedded magnetic core 103.

Through-holes 106 for forming primary and secondary side transformer windings are then drilled in the solid substrate 105 on the inside and outside circumferences of the toroidal magnetic component 103 (FIG. 1D). The through-holes are then plated with copper, to form vias 107, and metallic traces 108 are formed on the top and bottom surfaces of the solid substrate 105 to connect respective vias together into a winding configuration (FIG. 1E) and to form input and output terminals 109. In this way, a coil conductor is created around the magnetic component. The coil conductor shown in FIG. 1E is for an embedded transformer and has left and right coils forming primary and secondary side windings. Embedded inductors can be formed in the same way, but may vary in terms of the input and output connections, the spacing of the vias, and the type of magnetic core used.

A solder resist layer can then be added to the top and bottom surfaces of the substrate covering the metallic surface terminal lines, allowing further electronic components to be mounted on the solder resist layer. In the case of power supply converter devices, for example, one or more as transistor switching devices and associated control electronics, such as Integrated Circuit (ICs) and Operational Amplifiers (Op Amps) may be mounted on the surface resist layer.

Devices manufactured in this way have a number of associated problems. In particular, air bubbles may form in the epoxy gel as it is solidifying. During reflow soldering of the electronic components on the surface of the substrate, these air bubbles can expand and cause failure in the device.

US2011/0108317 also describes a second technique in which epoxy gel is not used to fill the cavity. This second technique will be described with respect to FIGS. 2A to 2E.

As illustrated in FIG. 2A, through-holes 202 are first drilled into a solid resin substrate 201 at locations corresponding to the interior and exterior circumference of an elongate toroidal magnetic core. The through-holes 202 are then plated up to form the vertical conductive vias 203 of the transformer windings, and metallic caps 204 are formed on the top and the bottom of the conductive vias 203 as shown in FIG. 2B. A toroidal cavity 205 for the magnetic core is then routed in the solid resin substrate 201 between the conductive vias 203 (FIG. 2C), and an elongate toroidal magnetic core 206 is placed in the cavity 205 (FIG. 2D). The cavity 205 is slightly larger than the magnetic core 206, and an air gap may therefore exist around the magnetic core 206.

Once the magnetic core 206 has been inserted into the cavity 205, an upper epoxy dielectric layer 207 (such as an adhesive bondply layer) is added to the top of the structure, to cover the cavity 205 and the magnetic core 206. A corresponding layer 207 is also added to the bottom of the structure (FIG. 2E) on the base of the substrate 201. Further through-holes are drilled through the upper and lower epoxy layers 207 to the caps 204 of the conductive vias 203, and plated, and metallic traces 208 are subsequently formed on the top and bottom surfaces of the device as before (FIG. 2F).

As noted above, where the embedded magnetic components of FIGS. 1A-1E and 2A-2F are transformers, a first set of windings 110, 210 provided on one side of the toroidal magnetic core form the primary transformer coil, and a second set of windings 112, 212 on the opposite side of the magnetic core form the secondary windings. Transformers of this kind can be used in power supply devices, such as isolated DC-DC converters, in which isolation between the primary and secondary side windings is required. In the example devices illustrated in FIGS. 1A-1E and 2A-2F, the isolation is a measure of the minimum spacing between the primary and secondary windings.

In the case of FIGS. 1A-1E and 2A-2F above, the spacing between the primary and secondary side windings must be large to achieve a high isolation value, because the isolation is only limited by the dielectric strength of the air, in this case in the cavity or at the top and bottom surfaces of the device. The isolation value may also be adversely affected by contamination of the cavity or the surface with dirt.

For many products, safety agency approval is required to certify the isolation characteristics. If the required isolation distance though air is large, there will be a negative impact on product size. For mains reinforced voltages (250 Vms), for example, a spacing of approximately 5 mm is required across a PCB from the primary windings to the secondary windings in order to meet the insulation requirements of EN/UL60950.

The inventors of the invention described and claimed in the present application discovered that it would be desirable to provide an embedded magnetic component device with improved isolation characteristics, and to provide a method for manufacturing such a device.

SUMMARY OF THE INVENTION

In a first aspect of various preferred embodiments of the present invention, a method of manufacturing a plurality of embedded magnetic component devices, each device including a magnetic core embedded in a cavity formed in an insulating substrate and one or more electrical windings formed around the core, includes a) preparing a mother base substrate including a row of cavities for respective magnetic cores, each of the cavities including a cavity floor and side walls connected by the cavity floor, and channels formed between the neighboring cavities in the mother base substrate so as to connect the cavities, each of the channels including a channel floor connected to the cavity floor; b) applying adhesive to the cavity floor and to one or more of the channels throughout the row of cavities; c) installing magnetic cores into the respective cavities so that the magnetic cores are secured in the cavities by the adhesive; d) applying an insulating layer to the mother base substrate to cover the magnetic cores and the cavities so as to obtain an insulated mother substrate; and e) forming electrical windings, passing through the mother substrate and respectively disposed around each of the magnetic cores, wherein the magnetic cores are secured in the cavities by the adhesive on the cavity floor.

The method may include dividing the insulating substrate into individual devices, each device including a magnetic core embedded in a cavity formed in an insulating substrate and one or more electrical windings formed around the core.

The method may further include dividing the insulating substrate at the intersection of the channels between neighboring cavities, the resulting devices including a channel connecting the cavity of the device to the exterior formed by the remaining channel sections on either side of the divide.

The method may also include applying a layer of adhesive to the cavity floor and channels. Applying the layer of adhesive may include applying one or more spots of adhesive to discrete locations inside the row of cavities, and causing the adhesive to flow between neighboring cavities via the channels. The method may further include applying one or more spots of adhesive to discrete locations in only the first cavity in the row of cavities, or applying the one or more spots of adhesive only to selected ones of the cavities in the row of cavities, so that some cavities do not initially receive adhesive.

The method may include inclining and/or agitating the row of cavities to assist with the flow of adhesive between the cavities.

The method may further include, before applying the adhesive, forming end channels between the end most cavities in the row and the exterior of the insulating substrate, the end channels including a channel floor and at least one obstruction portion where the channel floor is raised in comparison to the cavity floor which is deeper, the obstruction portion at least partially blocking egress of the adhesive applied during step b).

The method may further include forming the obstruction portion at the end of the end channel remote to the cavity, adjacent the exterior of the substrate.

The method may also include forming the obstruction portion as the entire length of the channel floor which is raised in comparison to the deeper cavity floor.

The method may also include installing the magnetic core in the cavity preserving at least one air gap between the magnetic core and the cavity or first insulating layer.

The method may also include forming the cavities to be slightly wider than the magnetic core such that when the magnetic core is installed in a cavity, between the cavity side walls, an air gap remains between the magnetic core and the cavity side walls.

The method may also include forming the cavities with side walls having a greater height than the height of the magnetic core such that when the magnetic core is installed in the cavity, an air gap remains between the magnetic core and the cavity side walls.

In preferred embodiments of the present invention, the cavity and the magnetic core may be toroidal.

The method may include maintaining the air gap between the magnetic core and the cavity side walls, and the air gap between the magnetic core and the first insulating later free of adhesive.

The method may also include before the dividing step: g) forming a second insulating layer on the upper winding layer covering the conductive winding sections formed on the first surface; h) forming a third insulating layer formed on the lower winding layer and covering the conductive winding sections of the lower winding layer; wherein the second and third insulating layers form a solid bonded joint with the respective upper and lower winding layers.

In a second aspect of various preferred embodiments of the present invention, an embedded magnetic component device includes: a base substrate including opposing first and second sides, and a cavity therein, the cavity including a cavity floor, side walls connected by the cavity floor; a magnetic core housed in the cavity; an insulating layer located on the base substrate to cover the cavity and the magnetic core and to define an insulated substrate; one or more electrical windings passing through the insulated substrate and disposed around the magnetic core and, a layer of adhesive located on the cavity floor, securing the magnetic core in the cavity, two or more channels located in the insulating substrate connecting the cavity to two or more portions of the exterior of the insulated substrate, each channel including a channel floor connecting to the cavity floor, wherein the layer of adhesive extends into the channel floor of at least one of the channels and the edge of the adhesive layer in the at least one channel extends to the exterior of the insulated substrate.

The insulating substrate may include four side surfaces as the exterior, and the channels may emerge on opposed ones of the side surfaces.

In a third aspect of various preferred embodiments of the present invention, a method of manufacturing a plurality of embedded magnetic component devices, each device including a magnetic core embedded in a cavity formed in an insulating substrate and one or more electrical windings formed around the core, includes: a) preparing a mother base substrate including a row of cavities for respective magnetic cores, each of the cavities including a cavity floor and side walls connected by the cavity floor, and channels formed between the neighboring cavities in the mother base substrate so as to connect the cavities, each of the channels including a channel floor connected to the cavity floor; b) installing magnetic cores into the respective cavities so that the magnetic cores are secured in the cavities by the adhesive; c) applying an insulating layer to the mother base substrate to cover the magnetic cores and the cavities so as to obtain an insulated mother substrate, the insulating layer including holes for receiving adhesive, the holes communicating with the channels between the magnetic cores; and d) dispensing adhesive into the channels through the holes so that the adhesive contacts the magnetic core and secures the magnetic core to the cavity floor throughout the row of cavities; and e) after completion of the individual devices, separating the components to form individual devices.

The mother base substrate may include connection portions and device portions, the connection portions located intermediate of neighboring device portions, the device portions each including a respective cavity for receiving a magnetic core, and the connection portions including at least a portion of the channel connecting neighboring device portions and at least one hole for receiving adhesive, wherein separating the components to form individual devices may include removing the connection portions between the device portions.

Completing the individual devices may include a step of forming electrical windings, passing through the mother substrate and respectively disposed around each of the magnetic cores, the step occurring before or after the step of dispensing the adhesive.

Further, the method may include forming the channels with a groove, leading from below the hole to the cavity.

The channel floor may be formed to slope away from the hole towards the cavities.

In a fourth aspect of various preferred embodiments of the present invention, a mother substrate includes a plurality of embedded magnetic component devices, a mother base substrate including a row of cavities, each of the cavities including a cavity floor and side walls connected by the cavity floor, and channels provided between the neighboring cavities so as to connect the cavities, each of the channels including channel walls connecting to the cavity floor; magnetic cores located in the cavities; and an insulating layer on the mother base substrate that defines an insulated mother substrate, the insulating layer including holes for receiving adhesive, communicating with the channels between the magnetic cores.

The mother base substrate may further include connection portions and device portions, the connection portions located intermediate of neighboring device portions, the device portions each including a respective cavity to receive a magnetic core, and the connection portions including at least a portion of the channel connecting neighboring device portions and at least one hole to receive adhesive.

The substrate may include electrical windings, passing through the insulated mother substrate and respectively disposed around each of the magnetic cores.

The channels may include a groove, leading from below the hole to the cavity.

The channel floor may slope away from the hole towards the cavities.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred Embodiment 1

A first example preferred embodiment of an embedded magnetic component device will now be described with reference to FIGS. 3A to 3G. A completed embedded magnetic component device according to the first example of the invention is illustrated in FIG. 3G.

The left and right sides of FIGS. 3A to 3G are schematic and intended only to illustrate the general composition of the device to the reader. The right sides of FIGS. 3A to 3G show elevation views of the top of the device as it is formed. The left sides of the device show a cross-section through the device intended to show the main components of the device. However, for clarity, some details have been omitted, and the plane of the cross-section modified. Where relevant this will be pointed out below.

Figure 1A:
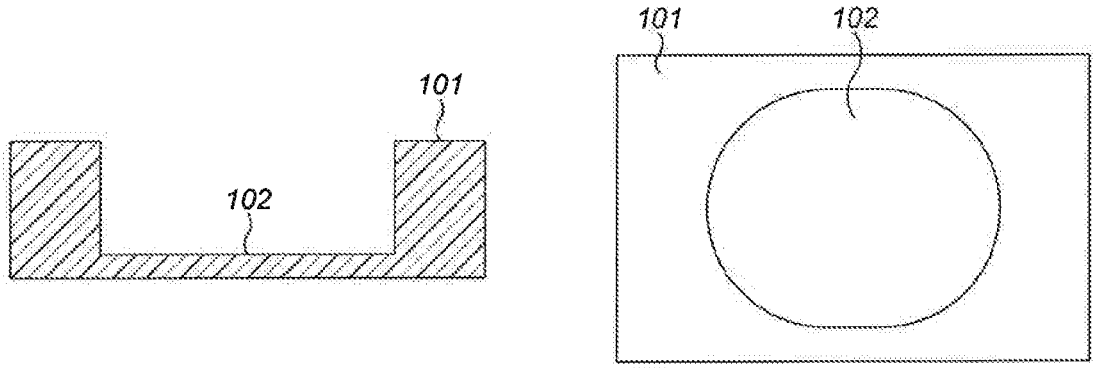
FIG. 1A (Prior Art)
FIGS. 1A to 1E illustrate a first known technique for manufacturing a substrate including an embedded magnetic component.
Figure 1B:
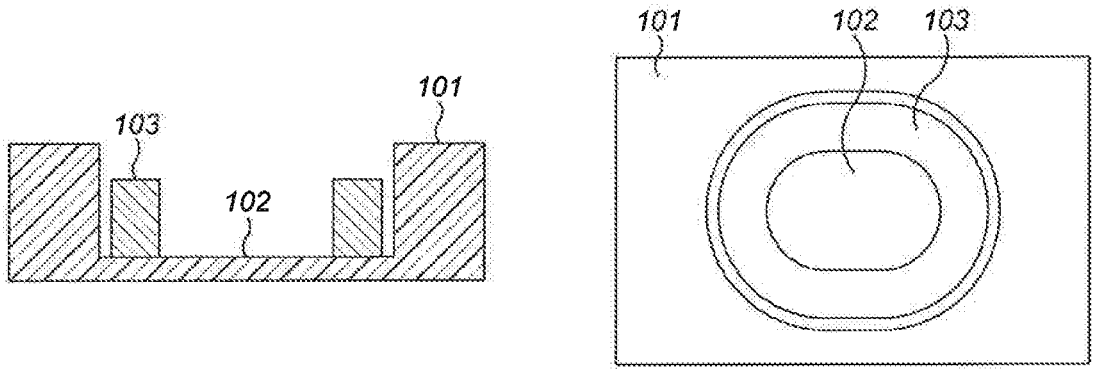
FIG. 1B (Prior Art)
Figure 1C:
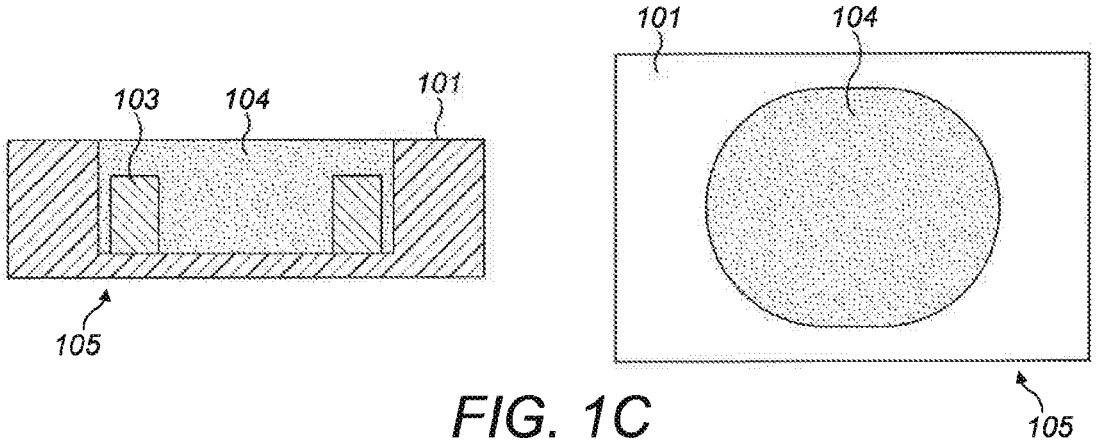
FIG. 1C (Prior Art)
Figure 1D:
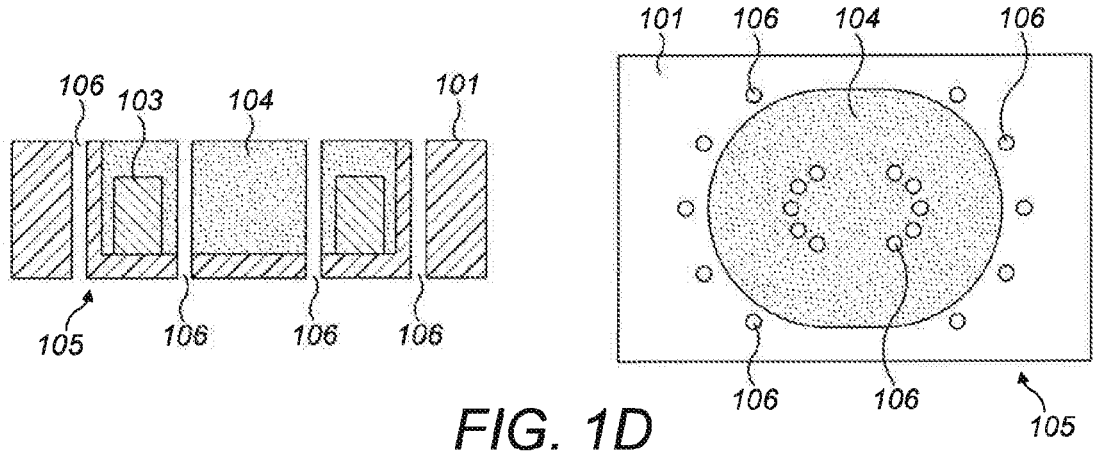
FIG. 1D (Prior Art)
Figure 1E:
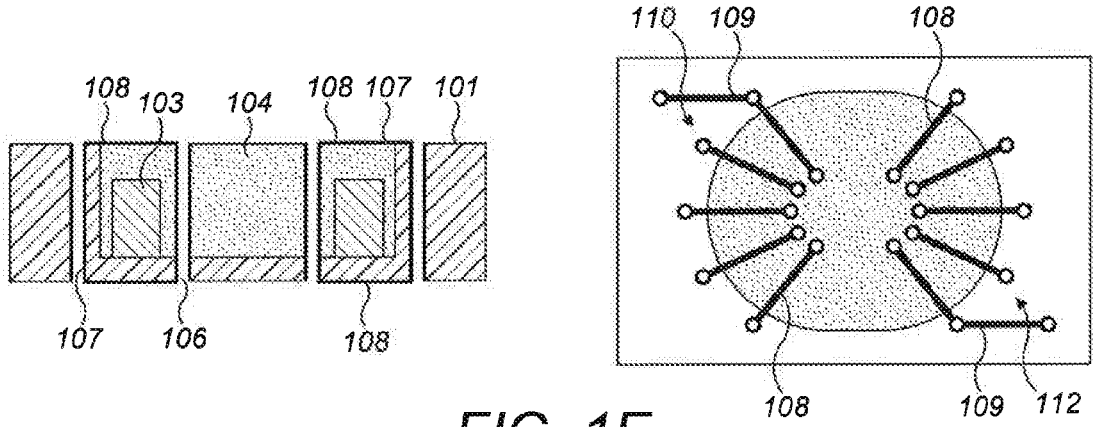
FIG. 1E (Prior Art)
Figure 2A:
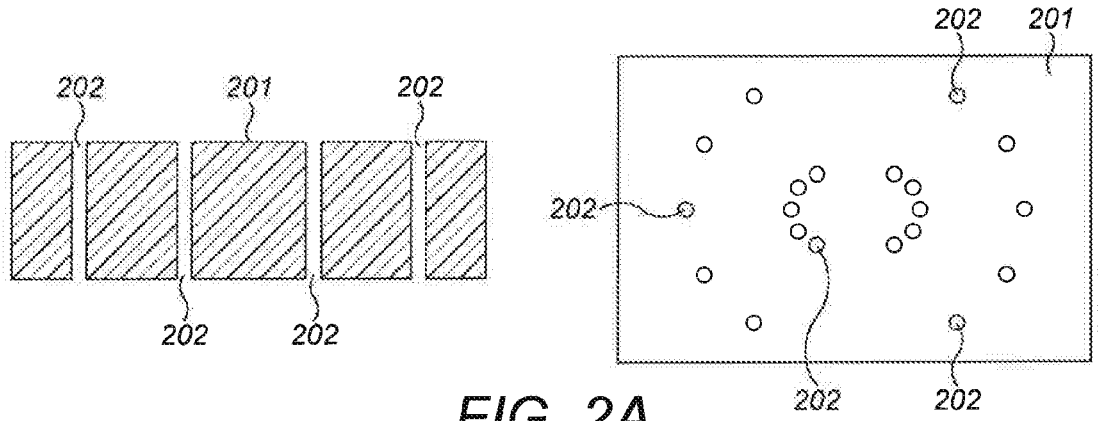
FIG. 2A (Prior Art)
FIGS. 2A to 2F illustrate a second known technique for manufacturing a substrate including an embedded magnetic component.
Figure 2B:
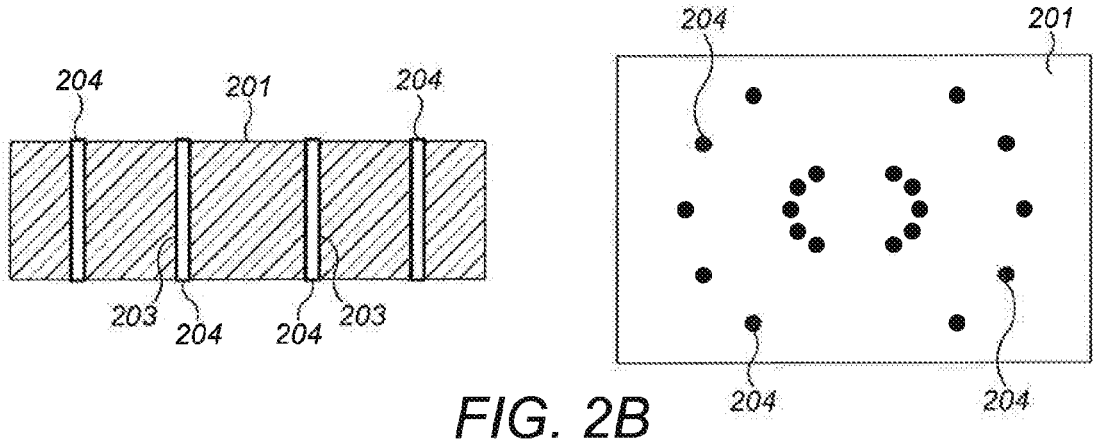
FIG. 2B (Prior Art)
Figure 2C:
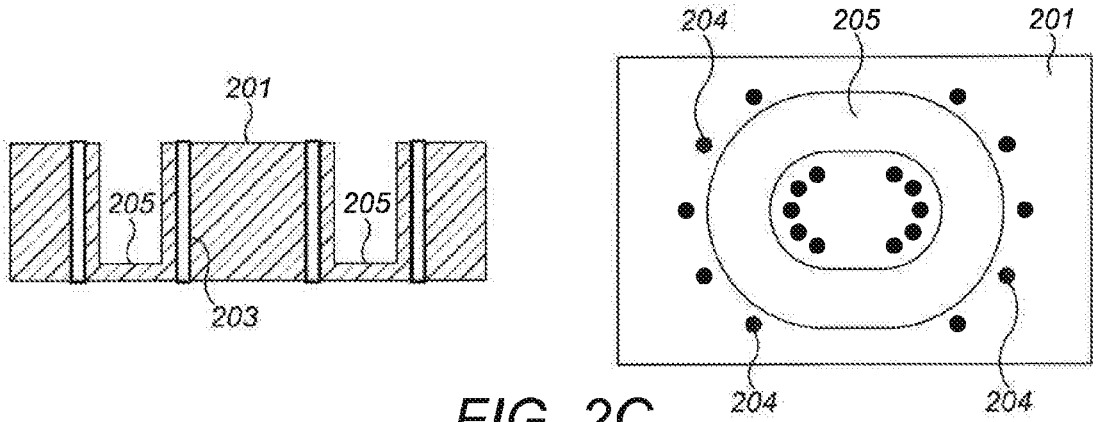
FIG. 2C (Prior Art)
Figure 2D:
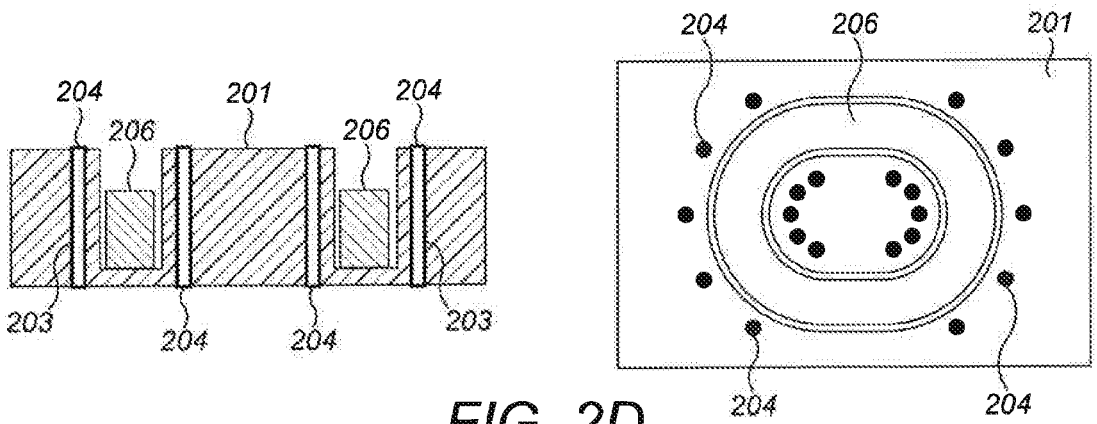
FIG. 2D (Prior Art)
Figure 2E:
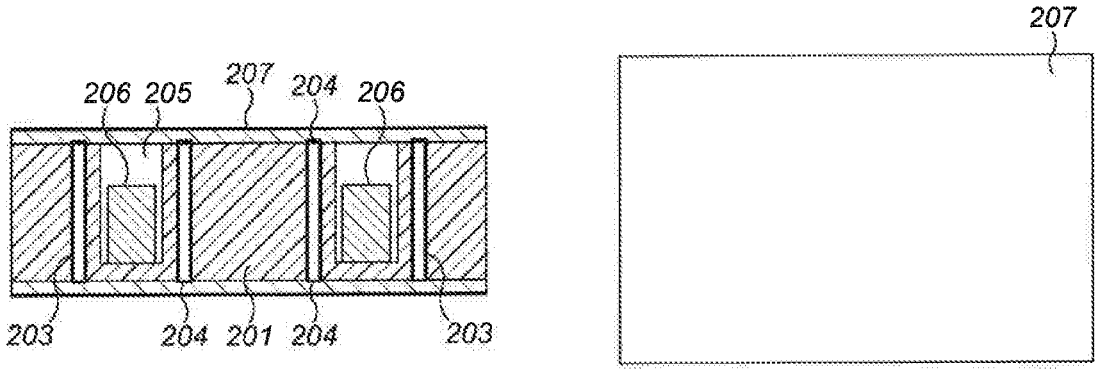
FIG. 2E (Prior Art)
Figure 2F:
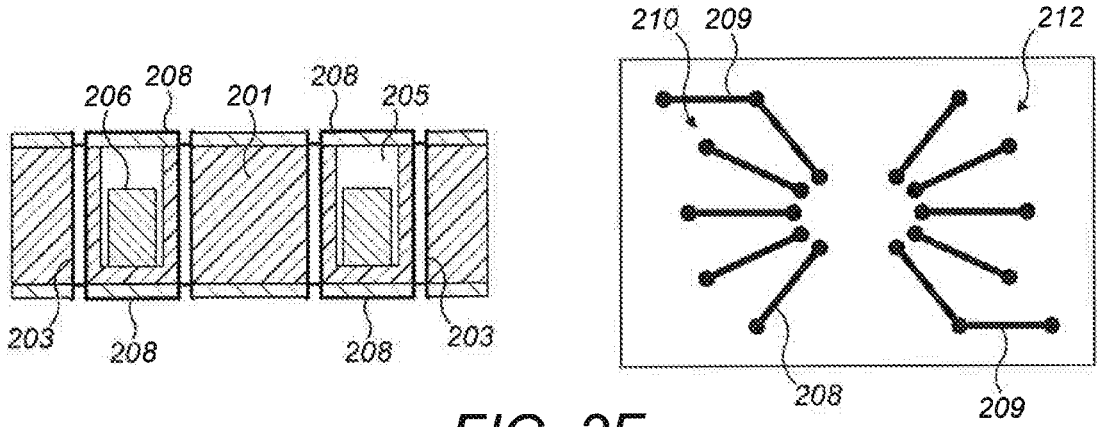
FIG. 2F (Prior Art)
Figure 3A:
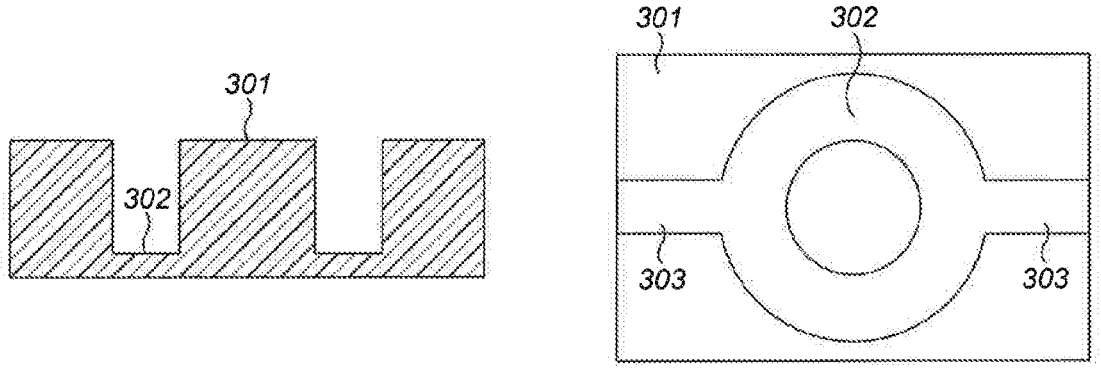
FIGS. 3A to 3G show a technique for manufacturing a device according to a first preferred embodiment of the present invention.

In a first step, illustrated in FIG. 3A, a circular annulus or cavity 302 for housing a magnetic core is routed or otherwise formed in an insulating substrate 301. In this example, the insulating substrate is formed of a resin material, such as FR4. FR4 is a composite 'pre-preg' material composed of woven fiberglass cloth impregnated with an epoxy resin binder. The resin is pre-dried, but not hardened, so that when it is heated, it flows and acts as an adhesive for the fiberglass material. FR4 has been found to have favorable thermal and insulation properties.

The cavity 302 also includes two channels 303 formed between the circular cavity 302 and the outside edges of the substrate 301. These channels may be formed by the router bit as it begins and concludes the routing process for the circular cavity 302. In the case of a single channel, the router bit may therefore enter and leave the substrate 301 via the same channel 303. In alternative preferred embodiments, the circular cavity 302 and channels 303 may be formed by building up resin layers in such a shape that the cavity and channels are formed. The channels 303 are not illustrated the left sides of FIGS. 3A to 3G for the sake of clarity, but are visible in the elevation view on the right side.

Figure 3B:
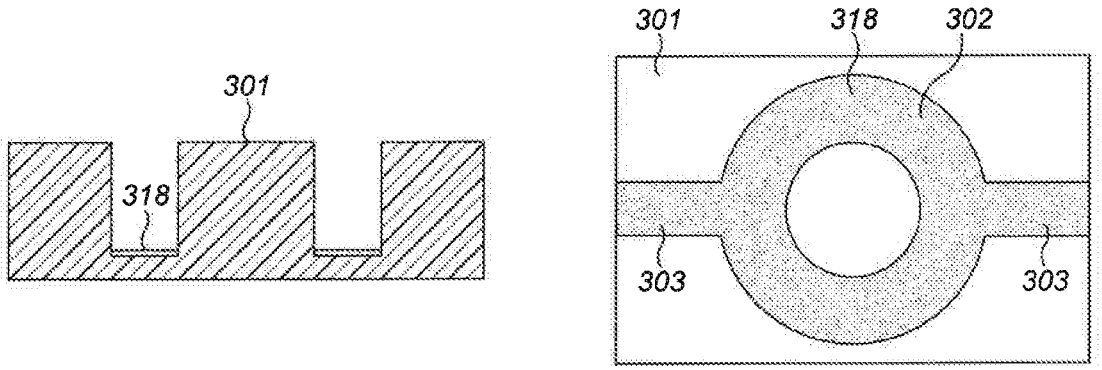
Figure 3C:
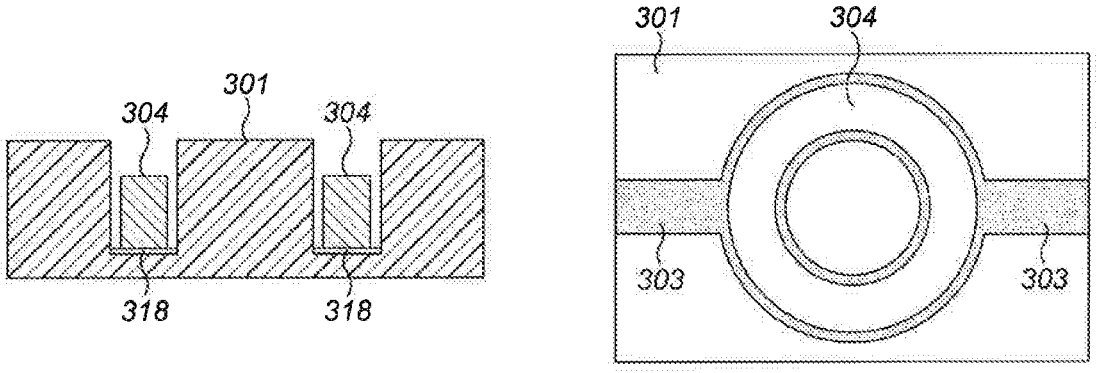

As illustrated in FIG. 3B, adhesive 318 is then applied to the base of the cavity 302. The adhesive may be applied by hand, or more preferably, by automated process, such as an X-Y gluing system. The adhesive may be any suitable silicon or epoxy based adhesive for example. As shown in FIG. 3C, a circular magnetic core 304 is then installed in the cavity 302. The cavity 302 may be slightly larger than the magnetic core 304, so that an air gap may exist around the magnetic core 304. The magnetic core 304 may be installed in the cavity manually or by a surface mounting device such as a pick and place machine. The magnetic core 304 is located on the adhesive so that a secure bond is formed between the magnetic core 304 and the cavity 302. Where the adhesive is a heat activated adhesive, a curing step of the adhesive may be carried out immediately, or later together with the steps for forming subsequent layers on the device (such as in connection with the step of FIG. 3D below).

Figure 3D:
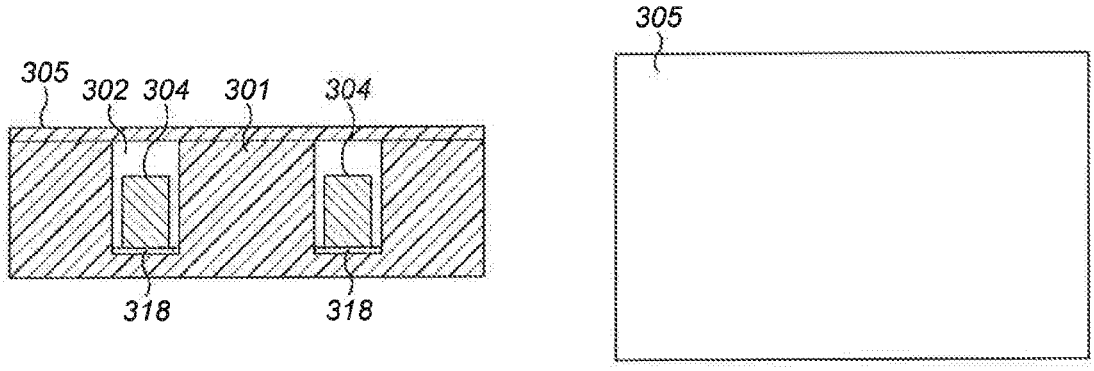

In the next step, illustrated in FIG. 3D, a first insulating layer 305 is secured or laminated on the insulating substrate 301 to cover the cavity 302 and magnetic core 304. Preferably, the insulating layer or first insulating layer 305 is formed of the same material as the insulating substrate 301 as this aids bonding between the top surface of the insulating substrate 301 and the lower surface of the first insulating layer 305. The first insulating layer 305 may therefore also be formed of a material such as FR4, laminated onto the insulating substrate 301. Lamination may be via adhesive or via heat activated bonding between layers of pre-preg material. In other preferred embodiments, other materials may be used for the layer 305.

Figure 3E:
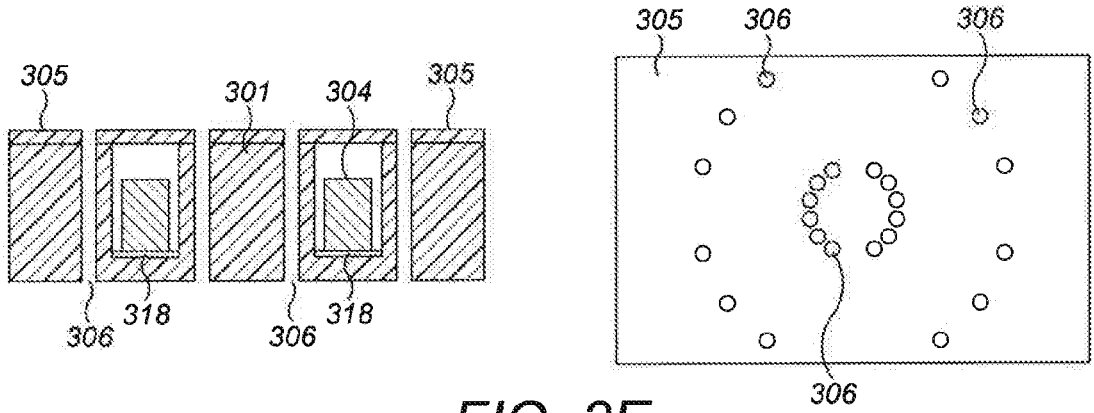

In the next step illustrated in FIG. 3E through-holes 306 are formed through the insulating substrate 301 and the first insulating layer 305. The through holes 306 are formed at suitable locations to form the primary and secondary coil conductor windings of an embedded transformer. In this example preferred embodiment, as the transformer includes the magnetic core 304 that is round or circular in shape, the through holes are therefore suitably formed along sections of two arcs corresponding to inner and outer circular circumferences. As is known in the art, the through-holes 306 may be formed by drilling or other suitable technique. Drilling may include using a drill bit or laser drilling for example. Due to the presence of the channels 303, the through holes are not formed at the 3 o'clock and 9 o'clock positions around the circular magnetic core, as this would put the through holes in the channel 303 itself. Instead, the through holes are arranged to avoid the channel. The cross-section illustrated on the left side of FIGS. 3A to 3G is arranged to show the through-holes 306. As a result of following a cross-section plane in which the through holes are visible, however the channels 303 are not visible.

Figure 4:
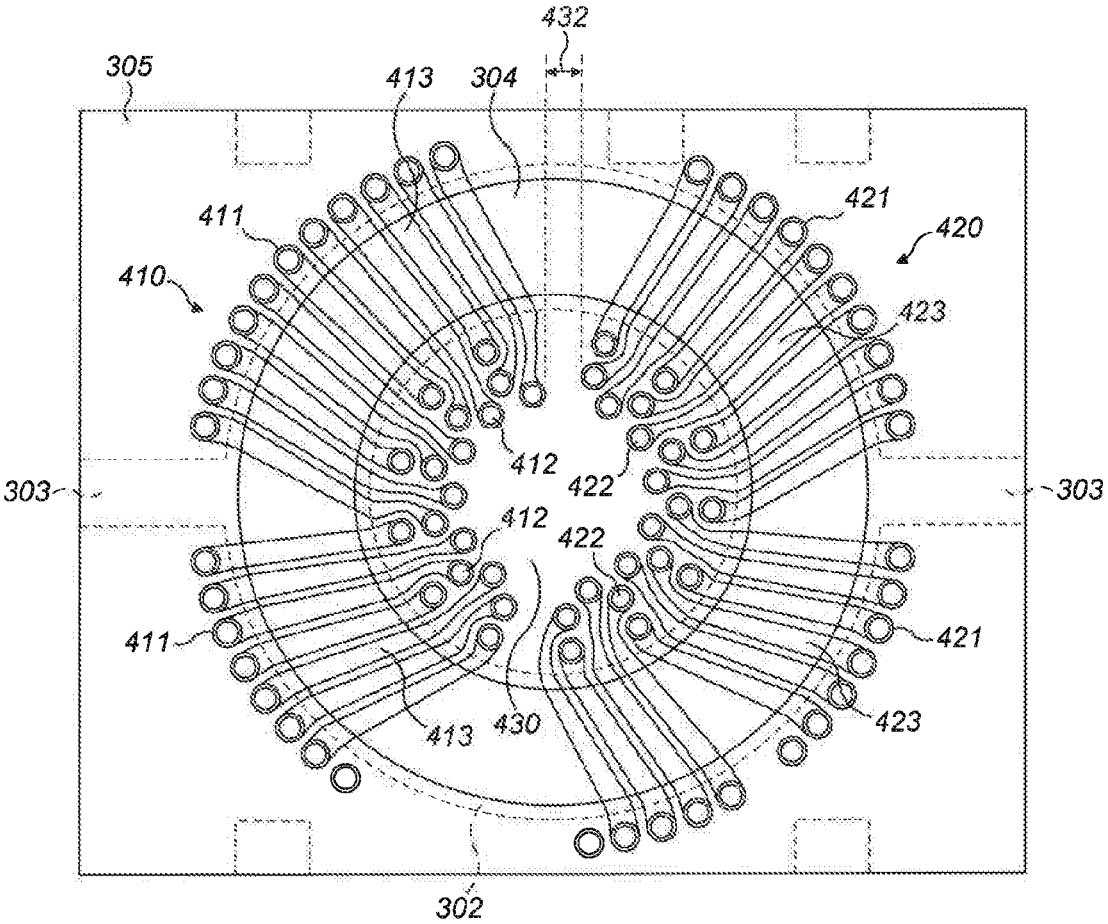
FIG. 4 illustrates a top down view of the cavity, the magnetic core, and the conductive vias.

A schematic illustration of an example pattern of conductive vias is shown in FIG. 4 and described below.

Figure 3F:
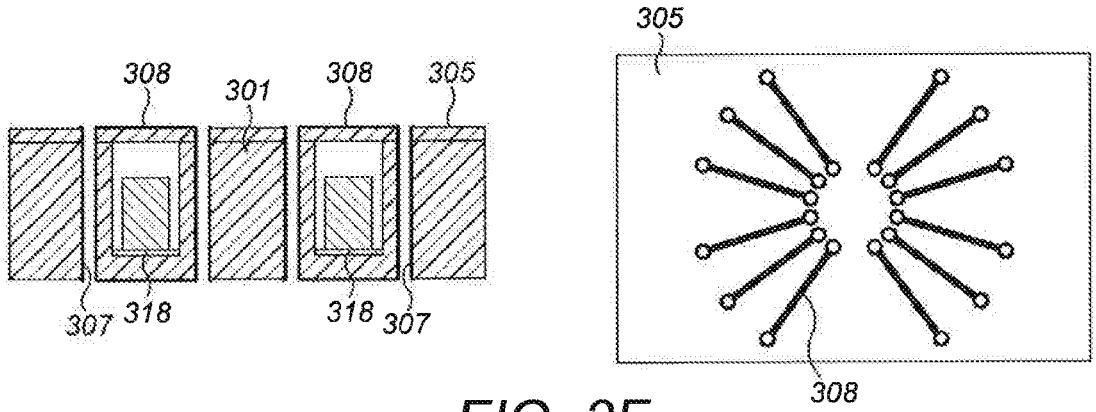
Figure 3G:
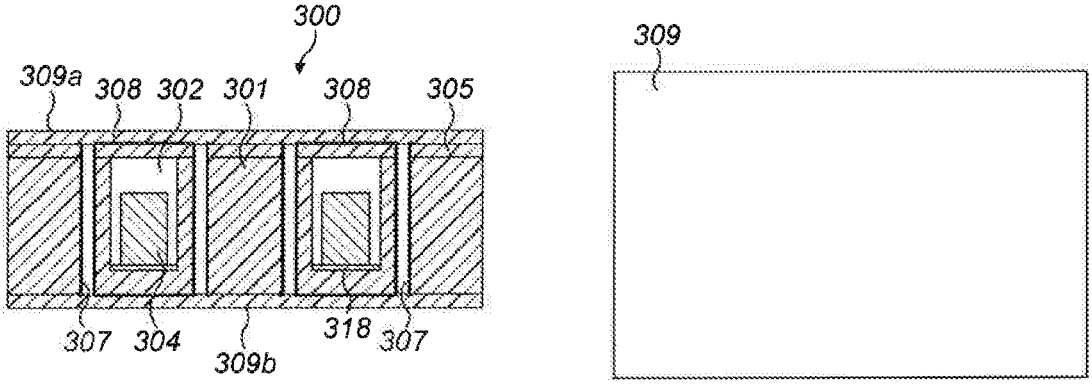

As shown in FIG. 3F, the through-holes 306 are then plated up to form conductive via holes 307 that extend from the top surface of the first insulating layer to the bottom surface of the substrate 301. Conductive or metallic traces 308 are added to the top surface of the first insulating layer 305 to form an upper winding layer connecting the respective conductive via holes 307, and a portion forming the windings of the transformer. The upper winding layer is illustrated by way of example in the right side of FIG. 3F. The metallic traces 308 and the plating for the conductive vias are usually formed from copper, and may be formed in any suitable way, such as by adding a copper conductor layer to the outer surfaces of the layer 305 which is then etched to form the necessary patterns, deposition of the copper onto the surface, and so on.

Metallic traces 308 are also formed on the bottom surface of the insulating substrate 301 to form a lower winding layer also connecting the respective conductive via holes 307 to partially form the windings of the transformer. The upper and lower winding layers 308 and the via holes 307 together form the primary and secondary windings of the transformer.

Lastly, as shown in FIG. 3G, second and third further insulating layers 309 are formed on the top and bottom surfaces of the structure shown in FIG. 3F. The layers may be secured in place by lamination or other suitable technique. The bottom surface of the second insulating layer 309*a* adheres to the top surface of the first insulating layer and covers the terminal lines 308 of the upper winding layer. The top surface of the third insulating layer 309*b* on the other hand adheres to the bottom surface of the substrate 301 and so covers the terminal lines 308 of the lower winding layer. Advantageously, the second and third layers may also be formed of FR4, and so laminated onto the insulating substrate 301 and first insulating layer 305 using the same process as for the first insulating layer 305.

Through holes and via conductors are formed through the second and third insulating layers in order to connect to the input and output terminals of the primary and second transformer windings (not shown). Where the vias through the second and third insulating layers are located apart from the vias through the substrate and the first insulating layer 305, a metallic trace will be needed on the upper winding layer connecting the input and output vias to the first and last via in each of the primary and secondary windings. Where the input and output vias are formed in overlapping positions, then conductive or metallic caps could be added to the first and last via in each of the primary and secondary windings.

The pattern of through holes 306, conductive vias 307 and metallic traces 308 forming the upper and lower winding layers of the transformer will now be described in more detail with reference to FIG. 4. FIG. 4 is a top view of the embedded magnetic component device with the upper winding layer exposed. The primary windings 410 of the transformer are shown on the left side of the device, and the secondary windings 420 of the transformer are shown on the right side. One or more tertiary or auxiliary transformer windings may also be formed, using the conductive vias 307 and metallic traces 308 but are not illustrated here. In FIG. 4, input and output connections to the transformer windings are also omitted to avoid obscuring the detail.

The primary winding of the transformer 410 includes outer conductive vias 411 arranged around the outer periphery of the circular cavity 302 containing the magnetic core 304. As illustrated here, the outer conductive vias 411 closely follow the outer circumference or periphery of the cavity 302 and are arranged in a row, along a section of arc on both sides of the left most channel 303.

Inner conductive vias 412 are provided in the inner or central region of the substrate, and are arranged in rows adjacent the inner circumference of the cavity 302 containing the magnetic core 304. Owing to the smaller radius circumscribed by the inner cavity wall compared to the outer cavity wall, there is less space to arrange the inner conductive vias 412 compared to the outer conductive vias 411. As a result, the inner conductive vias 412 are staggered and arranged broadly in two or more rows having different radius. Some of the inner conductive vias 412 in the primary winding are therefore located closer to the wall of the cavity 302 than the other inner conductive vias 412, which are located closer to the central portion of the device. In FIG. 4, the inner conductive vias can be seen to be arranged in three rows.

Each outer conductive via 411 in the upper winding layer 308 is connected to a single inner conductive via 412 by a metallic trace 413. The metallic traces 413 are formed on the surface of the first insulating layer 305 and so cannot overlap with one another. Although, the inner conductive vias need not strictly be arranged in rows, it is helpful to do so, as an ordered arrangement of the inner conductive vias 412 assists in arranging the metallic traces 413 so that they connect the outer conductive vias 411 to the inner conductive vias 412.

The secondary winding of the transformer 420 also includes outer conductive vias 421, and inner conductive vias 422 connected to each other by respective metallic traces 423 in the same way as for the primary winding.

The lower winding layer 308 of the transformer is arranged in the same way. The conductive vias are arranged in identical or complementary locations to those in the upper winding layers. However, in the lower winding layer 308 the metallic traces 413, 423 are formed to connect each outer conductive via 411, 421 to an inner conductive via 412, 422 adjacent to the inner conductive via 412, 422 to which it was connected in the upper winding layer. In this way, the outer 411, 421 and inner conductive vias 421, 422, and the metallic traces 413, 423 on the upper and lower winding layers 308 form coiled conductors around the magnetic core 304. It will be appreciated that the number of conductive vias allocated to each of the primary and secondary windings determines the winding ratio of the transformer.

In an isolated DC-DC converter, for example, the primary winding 410 and the secondary winding 412 of the transformer must be sufficiently isolated from one another. In FIG. 4, the central region of the substrate, the region circumscribed by the inner wall of the cavity 302, forms an isolation region 430 between the primary and the secondary windings. The minimum distance between the inner conductive vias 412 and 422 of the primary and secondary windings 410 and 420 is the insulation distance, and is illustrated in FIG. 4 by arrow 432.

Figure 5A:
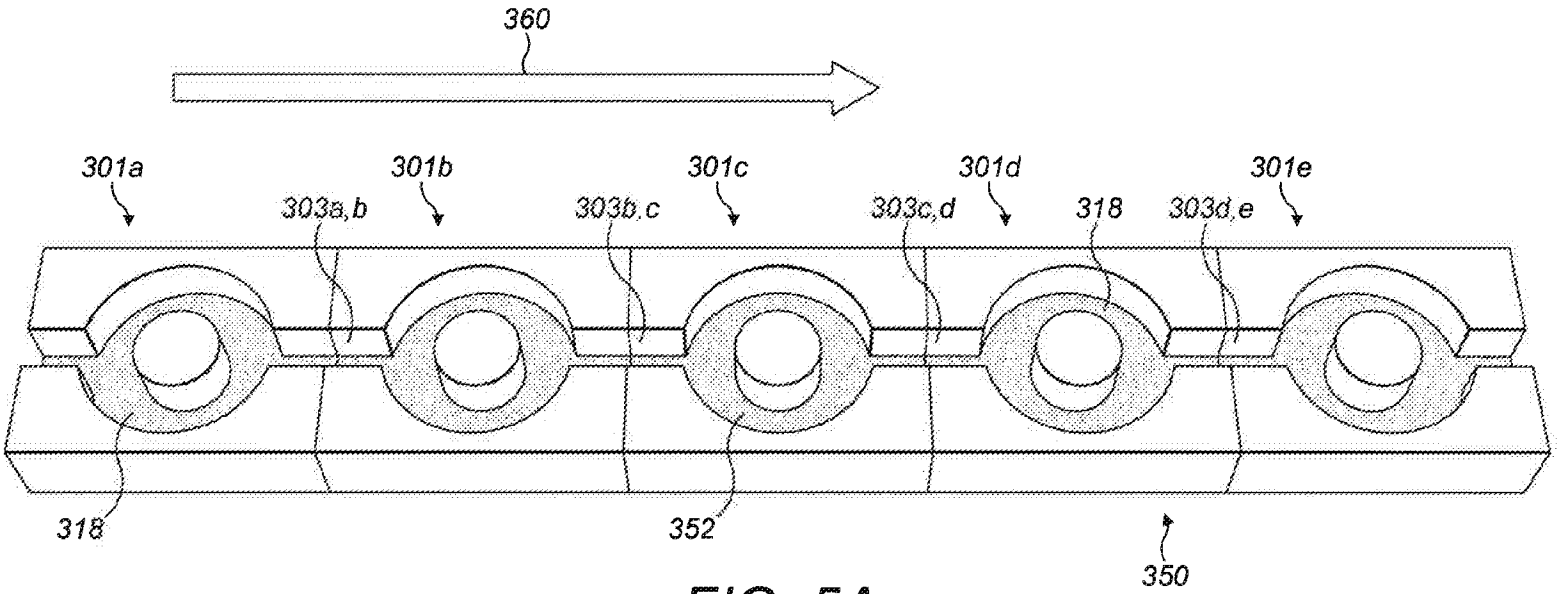
FIG. 5A is an isometric view of the cavity showing the adhesive applied in FIG. 3B.
Figure 5B:
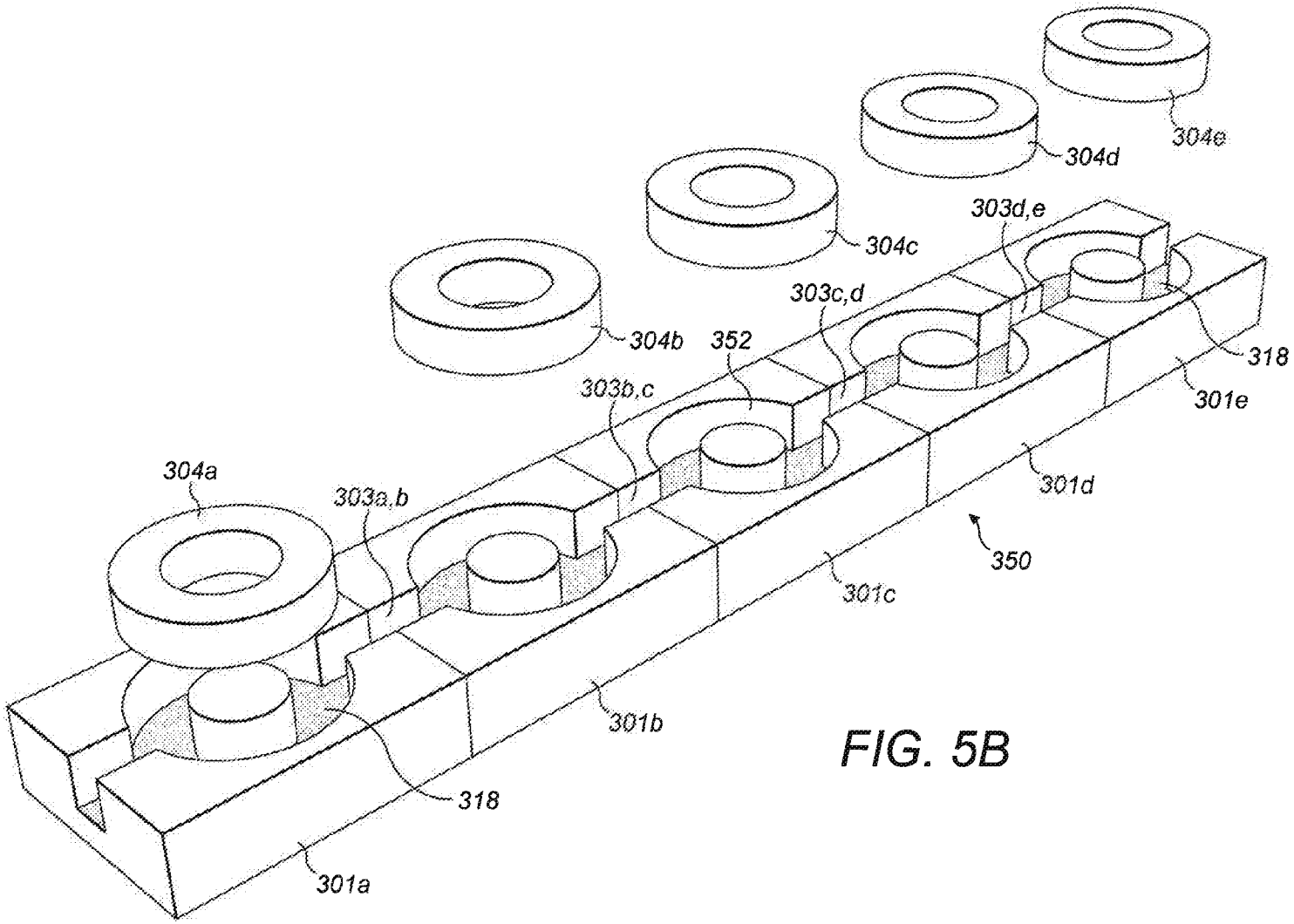
FIG. 5B is an isometric view of the installation of the magnetic core as shown in FIG. 3C.
Figure 5C:
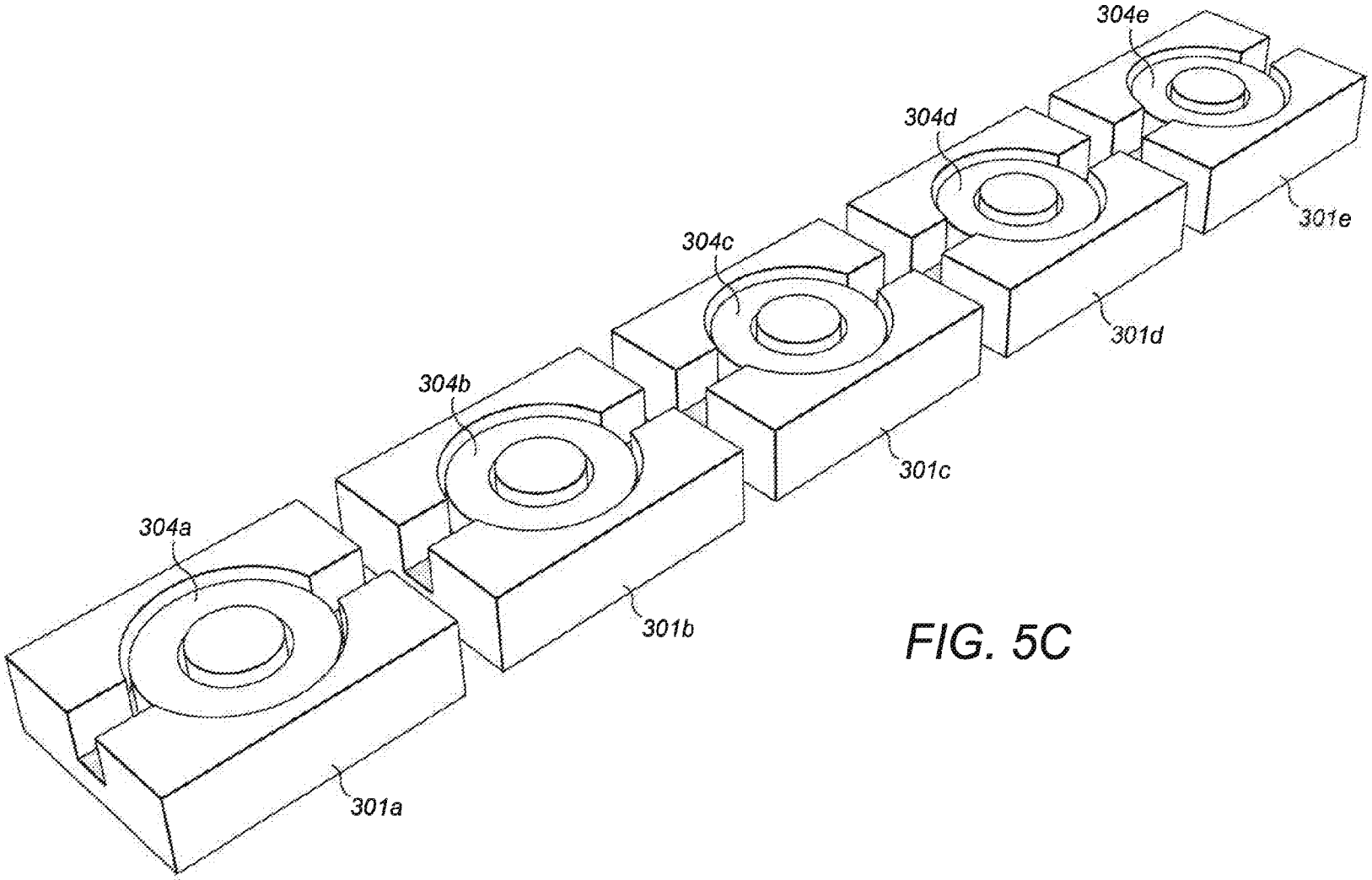
FIG. 5C is an isometric view of the substrate divided into a plurality of individual substrates.

FIGS. 5A, 5B and 5C to which reference should now be made, show further details of FIGS. 3A, 3B and 3C in isometric view, and in particular show a method for manufacturing a plurality of devices.

Referring to FIG. 5A, five device substrates 301*a* to 301*e* are connected to one another and arranged in a row or array 350, for example. The connected substrates may be referred to as a mother base substrate. The channels 303 of adjacent device substrates (e.g., 301*a* and 301*b*, 301*b* and 301*c* etc.) are aligned and connected to one another so that a single extended cavity 352 is formed throughout the row 350. The extended cavity 352 can therefore be seen to be formed from the toroidal or annular cavities 302*a* to 302*e* of the individual substrates 301 and their respective pairs of channels 303.

The end channels 303 of device substrates 301*a* and 301*e* at the ends of the row or array 350 have obstruction portions 330 where the channel 303 extends to the exterior of the device. The edge obstruction portions 330 are formed at a shallower depth than the cavities 302 and the other channels 303 in the interior of the row 350, and so form a dam. The obstruction sections 330 in the channels 303 act as dams to block the adhesive material applied to cavities 302, ensuring that the adhesive 318 remains in the cavities 302 and there is no adhesive contamination on the outside or outer edges 322 of the embedded magnetic component.

As shown in FIG. 5A, the adhesive 318 is preferably applied to the base of the cavity so that the entire cavity floor 350 is covered with the adhesive 318. The channels 303 arranged between adjacent device substrates (e.g., 301*a* and 301*b*, 301*b* and 301*c*, etc.) allow the adhesive to flow from the cavity 302 of one device substrate 301 to the cavity of the neighboring device substrate. The adhesive may be dispensed automatically or by hand. During application of the adhesive, or immediately thereafter, the row or array 350 may be agitated and/or inclined at one end so that the adhesive can flow aided by gravity. The adhesive may be applied as one or more spots of adhesive 318 in discrete locations inside the row of cavities, after which the adhesive is caused to flow between neighboring cavities via the channels. The flow of adhesive is indicated generally by arrow 360.

For example, the adhesive may be dispensed only to device substrate 301*a* and the row 350 tilted downwards so that device substrate 301*e* is lower than device substrate 301*a*. The adhesive will then flow along the channel 352 filling up the base of the cavity, and the obstructions sections 330 constraining the adhesive in the channel. In practice, adhesive may be applied at more than one location in the row 350, such as in every other cavity 302, or more specifically in the channels 303 between neighboring channels, so that a more even distribution of adhesive along the length of the channel is obtained. Some cavities may therefore not receive adhesive in the initial application, but only after the adhesive flows from a neighboring channel.

A plurality of magnetic cores 304*a* to 304*e* can then be installed in the glue-filled cavity 350 as shown in FIG. 5B, one core 304 per cavity. As a result of the adhesive 318 being applied across the entire base of the cavity 302, the bond formed between the magnetic core 304 and the cavity 302 is strong. This prevents movement of the magnetic core and means that the magnetic core 304 is protected from mechanical shocks and/or vibration damage that might otherwise occur during manufacture, transport or a customer application.

The use of adhesive 318 also means that the magnetic core 304 can be reliably positioned in the cavity 302, ensuring a consistent air gap between the core 304 and the cavity walls 320*a* and 320*b*. This improves the precision with which the embedded component devices can be manufactured, thus reducing device failure rates, and having a positive impact on the ability of the device to satisfy externally applied safety ratings or requirements.

In FIG. 5A, the edge obstructions sections 330 are shown at the outer edge of the edge-most channels 303, contiguous with the outer wall 322 of the substrate 301. The obstruction sections 330 may however be placed closer to the cavities 302 in the edge most device substrates 301, or even contiguous with the cavity 302, at the opposite end of the channel 303 to the outer wall 322.

In other preferred embodiments, the cavity 302 and the channels 303 may be formed in such a way that the entirety of the edge-most channels 303 acts as the obstruction section 330. In this way, the obstruction section 330 or the entirety of the edge-most channels 303 form material dams in the channel that prevent the movement or leakage of the dispensed adhesive to the outside of the device. Obstruction sections 330 may also be formed at intermediate points along the row or array (in the adjacent channel sections 303) so that the extended cavity 350 is in fact formed from a number of smaller extended cavities 350, each formed of at least two individual cavities 302 for an individual device substrate 301. The use of the dams 330 and the one or more extended cavities 350 to contain the adhesive 318 lead to significantly faster processing time during the production process.

The width of the obstruction section 330 may range between about 1 mm and the entire width of the channel 303, say about 3 mm, for example. Where the depth of the cavity 302 is about two thirds the depth of the substrate, the depth of the obstruction section 330 or raised channel section 330 may range from between about one half the depth of the substrate to about one quarter the depth of the substrate, for example. A depth of about one third of the substrate is preferred.

Although, five substrates 301 are shown connected in an array formation in FIG. 5A, for example, this is purely for illustration. In practice, a plurality of device substrates 301 will be formed in a sheet including many adjacent rows, with each row being like that shown in FIG. 5A or described above. The matrix or sheet will then be divided along the X and Y directions into individual component devices. Additionally, the rows need not be limited to five devices and could have a larger or smaller number of devices 301 connected together.

The cavity 302, and the raised channels 303, or channels with raised obstruction sections 330 may be formed by the same routing drill process. During the routing process, the routing drill bit is controlled to cut the path of the channels 303 and the cavity 302 in the X-Y plane, and is simultaneously controlled to cut to at least two different depths in the Z plane.

Once the magnetic cores 304 have been located in the cavities and the adhesive has hardened, it is necessary to divide the row or array 350 into separate device substrates 301. This is illustrated in FIG. 5C. As is known in the art, the row or array may be divided using a routing machine or a dicing machine or similar separation device. The cutting process used separates the row 350 into individual devices by cutting along the bisector of the channels 303, as well as separating adjacent rows from one another. In FIG. 5C, the cutting process is illustrated as occurring after the magnetic cores 304 have been installed in the cavity and the adhesive has hardened. In practice, however, it is advantageous to perform the cutting step after the row 350 of device substrates 301 have each individually been completed to the stage shown in FIG. 3F.

In the finished device, the presence of the channels 303 and the fact that the adhesive 318 is applied only to one side of the magnetic core 304 means that air can flow into and out of the cavity 302 during the subsequent stages of production. As a result, there is a considerable reduction of possible voids causing damage to the device during later reflow soldering stages of manufacture. Furthermore, when the component is complete, the channels 303 and air gap in the cavity 302 aids with cooling of the device during operation.

The equal distribution of adhesive 318 around the base of the cavity and, the bottom surface of the magnetic core 304 (when it is installed in the cavity 302), also distributes any potential stress to the magnetic core 304 equally around its circumference, and any potential stress to the substrate 301 equally across the surface area of the cavity 302.

Furthermore, the technique avoids the need to fully encapsulate the magnetic core 304 inside the cavity 302, such as in the known art illustrated in FIG. 1. As described earlier, it is not possible to guarantee when encapsulating the magnetic core that the resulting solid material will be free of voids. Any voids remaining in the material when the device is reflow soldered can expand and lead to device failure. Fully encapsulated products have also been found to present concerns with moisture.

Features of the embedded component device described above provide a number of further advantages. The second and third insulating layers 309*a* and 309*b* form a solid bonded joint with the adjacent layers, either layer 305 or substrate 301, on which the upper or lower winding layers 308 of the transformer are formed. The second and third insulating layers 309*a* and 309*b* therefore provide a solid insulated boundary along the surfaces of the embedded magnetic component device, greatly reducing the chance of arcing or breakdown, and allowing the isolation spacing between the primary and secondary side windings to be greatly reduced.

To meet the insulation requirements of EN/UL60950 only 0.4 mm is required through a solid bonded joint for mains referenced voltages (250 Vrms).

The second and third insulating layers 309*a* and 309*b* are formed on the substrate 301 and first insulating layer 305 without any air gap remaining between the layers. It will be appreciated that if there is an air gap in the device, such as above or below the winding layers, then would be a risk of arcing and failure of the device. The second and third insulating layers 309*a* and 309*b*, the first insulating layer 305 and the substrate 301, therefore form a solid block of insulating material.

In the prior art illustrated by FIGS. 1A-1E and 2A-2F, for example, the distance between the primary side and secondary side windings is about 5 mm. Due to the second and the third insulating layers provided in the present preferred embodiment, the distance 432 between the primary and secondary side is able to be reduced to about 0.4 mm, for example, allowing significantly smaller devices to be produced, as well as devices with a higher number of transformer windings. In this context, the spacing between the primary and secondary windings can be measured as the distance between the closest conductive vias in the primary side 411,412, and the secondary side 421,422, and/or between their associated metallic traces.

The second and third layers need only be on the top and bottom of the device in the central region between the primary and secondary windings. However, in practice it is advantageous that the second and third insulating layers cover the same area as that of the first layer 305 and substrate 301 on which they are formed. As will be described below, this provides a support layer for a mounting board on top, and provides additional insulation between the components on that board, and the transformer windings underneath.

The preferred thickness of the extra insulating layers 309 may depend on the safety approval required for the device as well as the expected operating conditions. For example, FR4 has a dielectric strength of around 750V per mil (0.0254 mm), and if the associated magnitude of the electric field used in an electric field strength test were to be 3000V, for example, such as that which might be prescribed by the UL60950-1 standard, a minimum thickness of 0.102 mm would be required for layers 309*a* and 309*b*. The thickness of the second and third insulating layers could be greater than this, subject to the desired dimensions of the final device. Similarly, for test voltages of 1500V and 2000V, the minimum thickness of the second and third layers, if formed of FR4 would be about 0.051 mm and about 0.068 mm, respectively, for example.

Although solder resist may be added to the exterior surfaces of the second and third insulating layers, this is optional in view of the insulation provided by the layers themselves, Although in the example described above, the substrate 301 and additional insulating layers 305, 309 are made of FR4, any suitable PCB laminate system having a sufficient dielectric strength to provide the desired insulation may be included. Non-limiting examples include FR4-08, G11, and FR5.

As well as the insulating properties of the materials themselves, the additional insulating layers 305 and 309 must bond well with the substrate 301 to form a solid bonded joint. The term "solid bonded joint" means a solid consistent bonded joint or interface between two materials with little voiding. Such a solid bonded joint should keep its integrity after relevant environmental conditions, for example, high or low temperature, thermal shock, humidity and so on. It should be noted that well-known solder resist layers on PCB substrates cannot form such a "solid bonded joint" and therefore the insulating layers 305 and 309 are different from such solder resist layers.

For this reason, the material for the extra layers is preferably the same as the substrate as this improves bonding between them. The layers 305, 309 and substrate 301 could however be made of different materials providing there is sufficient bonding between them to form a solid bonded joint. Any material chosen would also need to have good thermal cycling properties so as not to crack during use and would preferably be hydrophobic so that water would not affect the properties of the device.

In other preferred embodiments, the insulating substrate 301 could be formed from other insulating materials, such as ceramics, thermoplastics, and epoxies. These may be formed as a solid block with the magnetic core embedded inside. As before, first, second and third insulating layers 305, and 309 would then be laminated onto the substrate 301 to provide the additional insulation.

The magnetic core 304 is preferably a ferrite core as this provides the device with the desired inductance. Other types of magnetic materials, and even air cores, which are unfilled cavities formed between the windings of the transformer, are also possible in alternative preferred embodiments. Although, in the examples above, the magnetic core is circular in shape, it may have a different shape in other preferred embodiments. Non-limiting examples include, an oval or elongate toroidal shape, a toroidal shape having a gap, EE, EI, I, EFD, EP, UI and UR core shapes. In the present example, a round core shape was found to be the most robust leading to lower failure rates for the device during production. The magnetic core 304 may be coated with an insulating material to reduce the possibility of breakdown occurring between the conductive magnetic core and the conductive vias 307 or metallic traces 308. The magnetic core may also include chamfered edges providing a profile or cross section that is rounded.

Furthermore, although the embedded magnetic component device illustrated above preferably uses conductive vias 307 to connect the upper and lower winding layers 308, it will be appreciated that in alternative preferred embodiments, other connections could be used, such as conductive pins. The conductive pins could be inserted into the through holes 306 or could be pre-formed at appropriate locations in the insulating substrate 301 and first insulating layer 305.

In this description, the terms top, bottom, upper and lower are used only to define the relative positions of features of the device with respect to each other and in accordance with the orientation shown in the drawings, that is with a notional z axis extending from the bottom of the page to the top of the page. These terms are not therefore intended to indicate the necessary positions of the device features in use, or to limit the position of the features in a general sense.

Preferred Embodiment 2

In FIGS. 5A-5C, a technique for applying adhesive to the cavities prior to the insertion of the magnetic cores is discussed. In a second preferred embodiment, the adhesive may be applied to the cavities after the magnetic core is inserted. This preferred embodiment will now be described with reference to FIGS. 6A-6D.

Figure 6A:
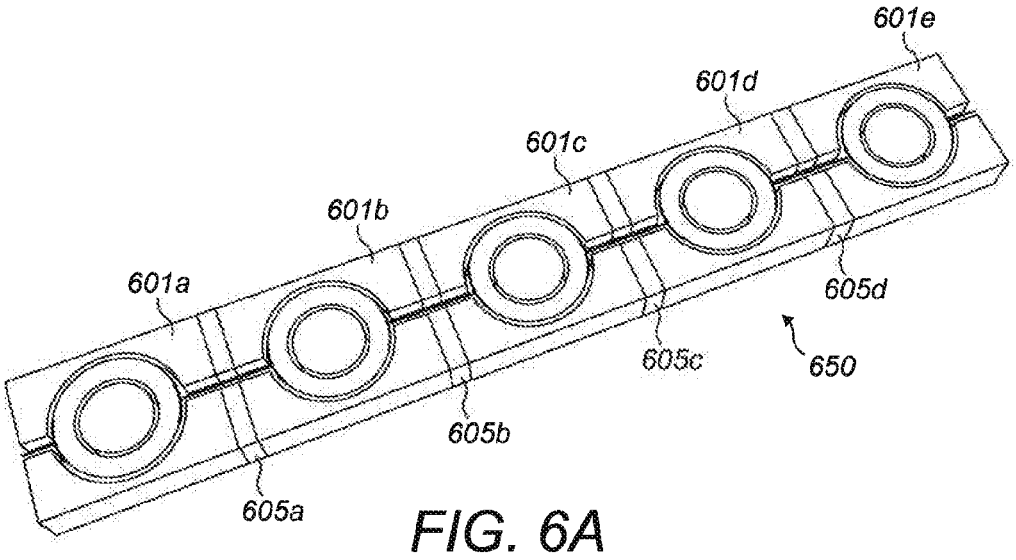
FIGS. 6A, 6B, 6C and 6D illustrate a second technique for manufacturing the device of FIG. 3G.
Figure 6B:
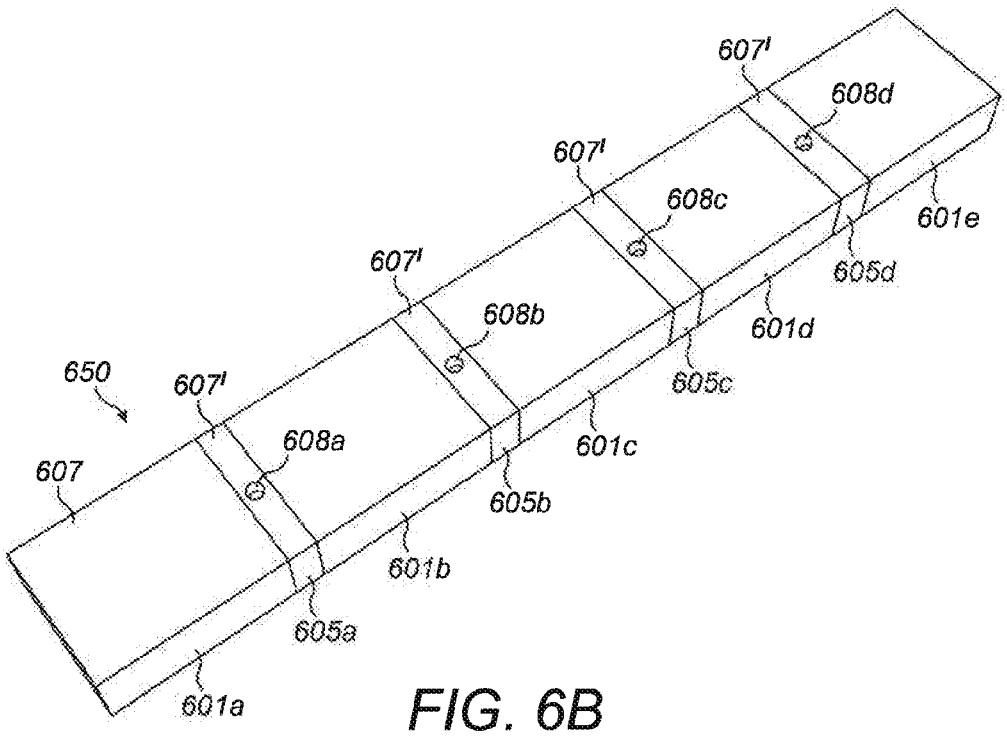
Figure 6C:
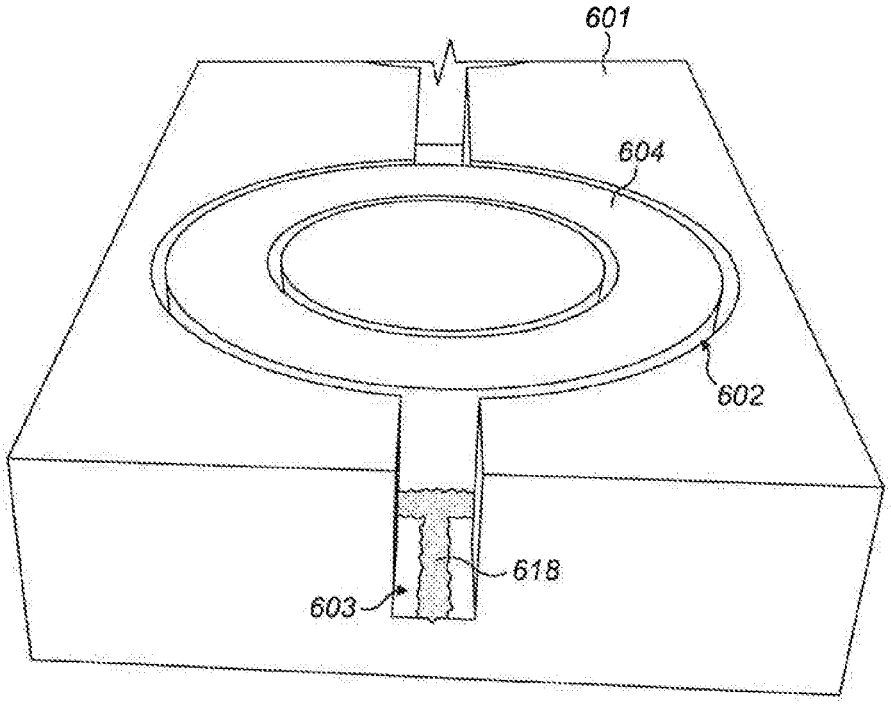

FIGS. 6A and 6B show a mother base substrate including five device portions 601*a* to 601*e* connected to one another and arranged in a row or array 650, for example. As shown in FIG. 6C, the device portions 601*a* to 601 each include a cavity 602, channels 603, and a magnetic core 604 located in the cavity 602. A single device portion 601 with adhesive 618 is illustrated more clearly in FIG. 6C.

The channels 603 of adjacent or neighboring device portions (e.g., 601*a* and 601*b*, 601*b* and 601*c*, etc.) are aligned and connected to one another so that a single extended cavity is formed throughout the row 650. The extended cavity is therefore formed by the toroidal or annular cavities 602*a* to 602*e* of the individual device portions 601 and their respective channels 603.

The end channels 603 of device substrates 601*a* and 601*e* at the ends of the row or array 650 may have obstruction portions where the channel 603 extends to the exterior of the device. The edge obstruction portions may be formed at a shallower depth than cavities 602 and the other channels 603 in the interior of the row 650, and so form a dam. The obstruction sections in the channels 603 act as dams to block the adhesive material applied to cavities 602, ensuring that the adhesive 618 remains in the cavities 602 and there is no adhesive contamination on the outside or outer edges of the embedded magnetic component.

Intermediate of the respective device portions 601 are connection portions 605*a*, 605*b*, 605*c* and 605*d*. The channels 603 pass through the connection portions 605*a* to 605*e* linking the cavities 602 in neighboring device portions. When the mother base substrate is processed to singulate the device portions 601*a* to 601*e*, the connection portions 605*a* to 605*d* are completely removed as will be discussed later. In practice, the connection portions 605*a* to 605*d* may be no more than about 2 mm in width, for example, and may be provided as routing slots of the mother substrate.

FIG. 6B shows the mother base substrate with the first insulating layer or cover layer 607 secured in place. The cover layer 607 extends the entire length of the row 650, covering the base substrate, the respective cavities 602, channels 603, the magnetic cores 604 of each of the individual device portions, and the connection portions 605, forming a mother substrate of individual device components. As with the earlier preferred embodiment, electrical windings may be formed on the cover layer 607 and the reverse side of the mother base substrate before the individual device portions are separated from one another. The electrical windings and the step of forming the windings on the cover layer 607 and the reverse side of the mother base substrate are not illustrated in FIGS. 6A-6D.

The cover layer 607 is a single component that may be laminated or otherwise secured to the base substrate to form an insulated mother substrate. As with the earlier preferred embodiment, it is preferable if the cover layer is secured to the mother base substrate 601 to form a solid bonded joint.

Figure 6D:
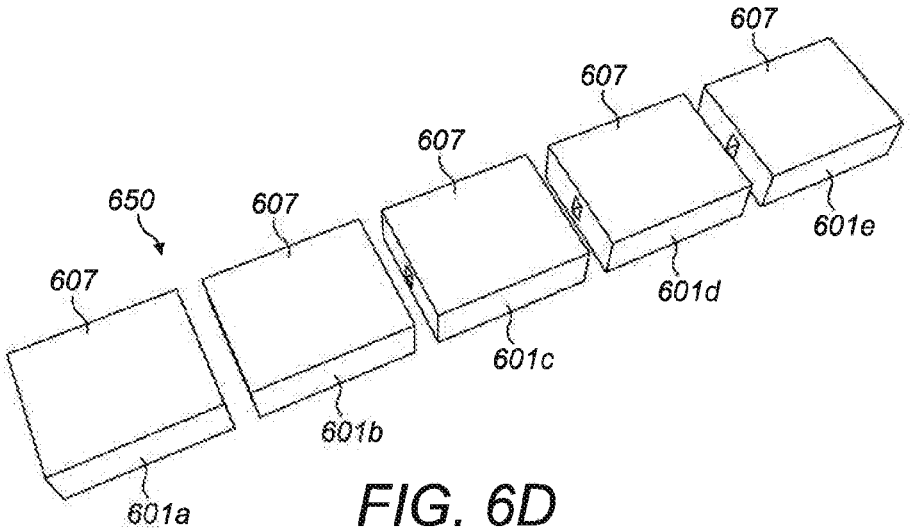

Regions 607' of the cover layer 607 correspond in position to the connection portions of the mother base substrate. In FIG. 6B, these regions are labelled 607'. Like the connection portions 605, the connection regions 607' are removed when the individual devices 601*a* to 601*e* are singulated from one another. Singulated devices made up of the device portions 601*a* to 601*e* and the respective sections of cover layer 607 are illustrated in FIG. 6D. As noted above, this diagram does not show the formation of the electrical windings, though this can be achieved via the technique discussed above with reference to FIGS. 3A-3G and 4 before singulation occurs or after.

As illustrated in FIG. 6B, in each of the connection regions 607', a hole 608 is provided that passes completely through the layer 607. At least one hole 608*a*, 608*b*, 608*c* and 608*d* is provided for each of the connection portions 605*a*, 605*b*, 605*c*, and 605*d*. Each hole is positioned above the respective channels 603 and in the center of the row 650. In this way, the channel 603 in each of the connection portions 605*a*, 605*b*, 605*c* and 605*d* is in fluid communication with the exterior of the mother substrate. The size of the hole is sufficient to receive adhesive via an adhesive dispensing tool.

FIG. 6C is a close-up view of one of the channels 603 in one of the connection portions 605*a*, 605*b*, 605*c*, or 605*d*, into which adhesive 618 has been dispensed. The adhesive is dispensed initially into the channel 603 via the hole 608*a*, 608*b*, 608*c* and 608*d* and so flows along the channel in both directions away from the hole 608*a*, 608*b*, 608*c* and 608*d* into the neighboring cavities 602 and into contact with the magnetic cores 604. Once the adhesive is set, this ensures that both ends of each magnetic core 604 where they are adjacent the channels 603 is secured in place.

For the magnetic cores that are located in the end device portions of the row 650, and which on one side have no neighboring cavity or hole for receiving adhesive, adhesive may still be applied to the magnetic core manually via insertion into the end channel 603. Alternatively, no adhesive may be inserted such that the magnetic cores of the end device portions are held in place only by the adhesive that flows into the magnetic core from one side. Alternatively, the viscosity of the adhesive that is dispensed is selected so that the adhesive flows around the magnetic core 604 from one side to the other. The end channel 603 at the end of the mother substrate may therefore have a solid wall, a lower profile dam, or may simply be open to the exterior of the row.

In order to assist the flow of adhesive from each of the holes 608*a* to 608*d* and on to the magnetic cores 604, a groove may be provided in the base of the channel leading from below the hole to the cavity 602. The groove may be angled into the substrate so that it is deeper at the cavity 602 and magnetic core 604 than where it is under the hole 608*a* to 608*d*. The width of the groove may also increase away from the hole 608*a* to 608*d* so that the groove is widest where it flows into the cavity 602 and adjoins the magnetic core. Alternatively or in conjunction with the groove, the depth of the channel 603 may vary, so that it is less deep underneath the holes 608*a* to 608*d*, and deeper at the cavity 602 and magnetic core. The sloping floor of the channel that is so formed ensures that the adhesive is directed onto the magnetic core 604.

When forming a device using this method, the mother base substrate is prepared in the same way as before to include the cavities 602, channels, 603 and magnetic cores 604. The cover layer 607 is then secured to the top surface of the mother base substrate to form a solid bonded joint. The holes 608*a* to 608*d* may be formed in the cover layer 607 before the cover layer is applied to the mother base substrate or alternatively in a separate drilling step.

Again although, only a single row of five substrates 601 are shown connected in an array formation in FIG. 6A, for example, this is purely for illustration. In practice, a plurality of device substrates 601 will be formed in a matrix or sheet comprised of many adjacent rows, with each row being like that shown in FIG. 6A or described above. The matrix or sheet will then be divided along the X and Y directions into individual component devices. Additionally, the rows need not be limited to five devices and could have a larger or smaller number of devices 601 connected together.

These steps can be carried out by an operator using an X-Y table, for example. Adhesive is then dispensed into the strategically placed holes. The dispensing holes 608*a* to 608*d* receive the required amount of adhesive from an operator using the X-Y table. The adhesive runs outwards from the holes 608*a* to 608*d* channeling through into the cavities 602 via the channels 603 from each side of the dispensing point, and running onto the magnetic cores 604. The dispenser is set to a flow rate that ensures that it will not block the channels or the gaps between the magnetic cores 604 and the cavity side walls to ensure that air vent gaps are maintained on each side of the components.

A routing or dicing process, for example, then singulates the components entirely removing the connecting portions 605*a* to 605*e* with the adhesive dispensing holes. To facilitate this, the routing process may occur exactly down the center line of the two neighboring device portions 601*a* to 601*e*, cutting through the substrate 601, cover layer 607 and any adhesive material 618.

The use of the dispensing holes 608*a* to 608*d* in the manner described results in faster processing time for the step of dispensing the adhesive, as well as eliminating any risk of adhesive contamination to the outer edges of the component.

Other Preferred Embodiments

Figure 8:
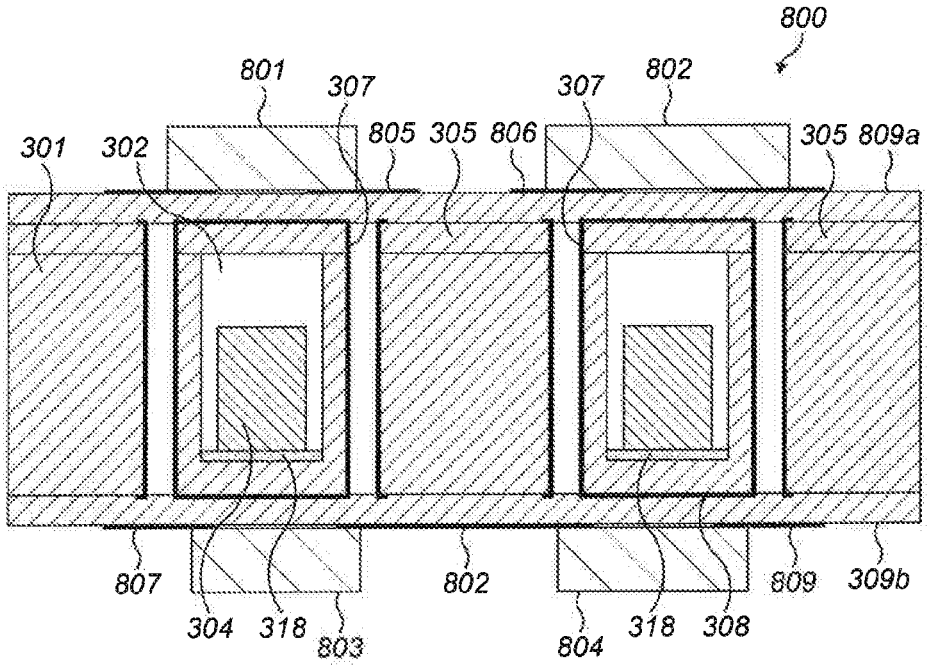
FIG. 8 illustrate a further example preferred embodiment, incorporating the embedded magnetic component device of FIG. 3F or 7 into a larger device.
Figure 9:
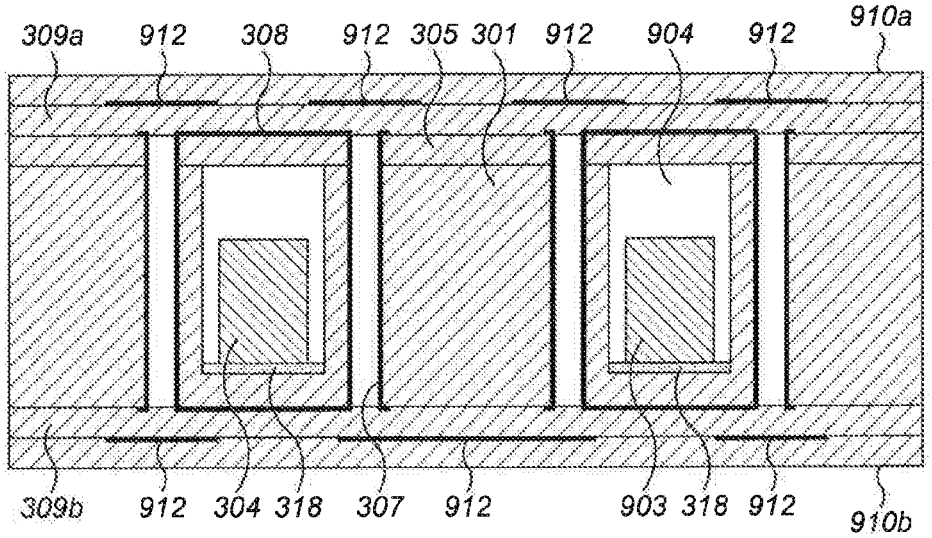
FIG. 9 illustrates a further example preferred embodiment of a finished component device including further layers of insulating material.

Having described a first example device preferred embodiment, and first and second example methods for manufacture, further example preferred embodiments of devices will now be described with reference to FIGS. 7 to 9. These can all be made utilizing the manufacturing techniques discussed above.

Figure 7:
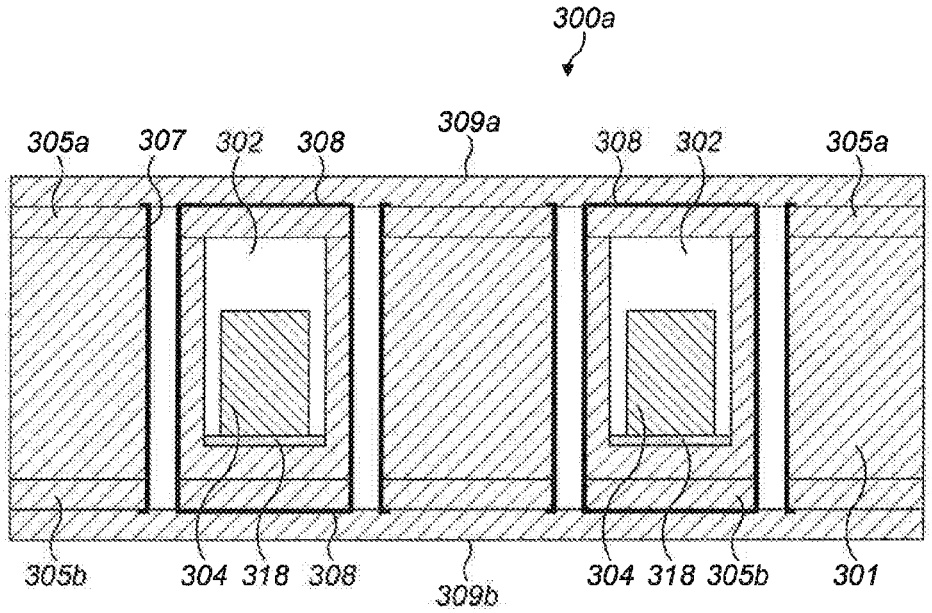
FIG. 7 illustrates an alternative preferred embodiment of a finished magnetic component device.

In a first example, illustrated in FIG. 7, the structure of the device 300*a* is identical to that illustrated in FIGS. 3A-3G, but in the step illustrated in FIG. 3D, before the through holes 306 are formed, an additional layer, fourth insulating layer 305*b*, is laminated onto the insulating substrate 301. The through holes are then formed through the substrate 301, and the first 305*a* and fourth 305*b* insulating layers, and the through holes 306 are plated to form conductive vias 307. Thus, as illustrated in FIG. 7, in this preferred embodiment, when the lower winding layer 308 is formed, in the step previously illustrated in FIG. 3F, it is formed on the fourth insulating layer 305*b*, rather than the on the lower side of the insulating substrate 301. The fourth insulating layer 305*b* provides additional insulation for the lower winding layer 308.

In addition to significantly improving the electrical insulation between the primary and secondary side windings of the transformer, the second and third insulating layers 309*a* and 309*b* usefully serve as the mounting board on which additional electronic components can be mounted. This allows the insulating substrate 301 of the embedded magnetic component device to act as the PCB of more complex devices, such as power supply devices. In this regard, power supply devices may include DC-DC converters, LED driver circuits, AC-DC converters, inverters, power transformers, pulse transformers and common mode chokes for example. As the transformer component is embedded in the substrate 301, more board space on the PCB is available for the other components, and the size of the device can be made small.

A further example preferred embodiment will now be described with reference to FIG. 8. FIG. 8 shows example electronic components 801, 802, 803 and 804, surface mounted on the second and third insulating layers 309*a* and 309*b*. These components may include one or more resistors, capacitors, switching devices such as transistors, integrated circuits and operational amplifiers, for example. Land grid array (LGA) and Ball Grid Array components may also be provided on the layers 309*a* and 309*b*.

Before the electronic components 801, 802, 803 and 804 are mounted on the mounting surface, a plurality of metallic traces are formed on the surfaces of the second and third insulating layers 309*a* and 309*b* to make suitable electrical connections with the components. The metallic traces 805, 806, 807, 808 and 809 are formed in suitable positions for the desired circuit configuration of the device. The electronic components can then be surface mounted on the device and secured in place by reflow soldering, for example. One or more of the surface mounted components 801, 802, 803 and 804 preferably connects to the primary windings 410 of the transformer, while one or more further components 801, 802, 803 and 804 preferably connects to the secondary windings 420 of the transformer. The resulting power supply device 800 shown in FIG. 8 may be constructed based on the embedded magnetic component devices 300 and 300*a* shown in FIG. 3F or 7 for example.

A further example will now be described with reference to FIG. 9. The embedded magnetic component of FIG. 9 is identical to that of FIGS. 3F and 7 except that further insulating layers are provided on the device. In FIG. 9, for example, additional metallic traces 912 are formed on the second and third insulating layers 309*a* and 309*b*, and additional insulating layers 910*a* and 910*b* are then formed on the metallic traces 912. As before, the fifth and sixth insulating layers 910*a* and 910*b*, can be secured to the second and third layers 909*a* and 909*b* by lamination or adhesive.

The additional layers 910*a* and 910*b* provide additional depth in which circuit lines can be constructed. For example, the metallic traces 912 can be an additional layer of metallic traces to metallic traces 805, 806, 807, 808 and 809, allowing more complicated circuit patterns to be formed. Metallic traces on the outer surface 805, 806, 807, 808 and 809 can be taken into the inner layers 910*a* and 910*b* of the device and back from it, using conductive vias. The metallic traces can then cross under metallic traces appearing on the surface without interference. Interlayers 810*a* and 810*b* therefore allow extra tracking for the PCB design to aid thermal performance, or more complex PCB designs. The device shown in FIG. 9, may therefore advantageously be used with the surface mounting components 801, 802, 803 and 804 shown in FIG. 8.

Alternatively, or in addition, the metallic traces of the fifth and sixth additional insulating layers 910*a* and 910*b* may be used to provide additional winding layers for the primary and secondary transformer windings. In the examples discussed above, the upper and lower windings 308 preferably are formed on a single level, for example. By forming the upper and lower winding layers 308 on more than one layer, it is possible to put the metallic traces of one layer in an overlapping position with another layer. This means that it is more straightforward to take the metallic traces to conductive vias in the interior section of the magnetic core, and potentially more conductive vias can be incorporated into the device.

Only one of two additional insulating layers 910*a* or 910*b* may be necessary in practice. Alternatively, more than one additional insulating layer 910*a* or 910*b* may be provided on the upper or lower side of the device. The additional insulating layers 910*a* and 910*b* may be used with any of the devices illustrated above.

In all of the devices described, an optional solder resist cover may be added to the exterior surfaces of the device, either the second and third insulating layers 309*a* and 309*b*, or the fifth and sixth insulating layers 310*a* and 310*b*.

Example preferred embodiments of the present invention have been described for the purposes of illustration only. These are not intended to limit the scope of protection as defined by the attached claims. It will be appreciated that features of one preferred embodiment may be used together with features of another preferred embodiment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An embedded magnetic component device comprising:

a base substrate including opposing first and second sides, and a cavity therein, the cavity including a cavity floor, side walls connected by the cavity floor;

a magnetic core housed in the cavity;

an insulating layer located on the base substrate to cover the cavity and the magnetic core and to define an insulated substrate;

one or more electrical windings passing through the insulated substrate and disposed around the magnetic core;

a layer of adhesive located on the cavity floor, securing the magnetic core in the cavity; and two or more channels located in the insulating substrate and connecting the cavity to two or more portions of an exterior of the insulated substrate, each of the two or more channels including a channel floor connecting to the cavity floor; wherein the layer of adhesive extends into the channel floor of at least one of the channels and an edge of the adhesive layer in the at least one channel extends to the exterior of the insulated substrate.

2. The device of claim 1, wherein the insulating substrate includes four side surfaces, and the channels emerge on opposed ones of the four side surfaces.

* * * * *